US006672705B2

(12) United States Patent
Kitahara et al.

(10) Patent No.: US 6,672,705 B2
(45) Date of Patent: Jan. 6, 2004

(54) PRINTER

(75) Inventors: Toshihiro Kitahara, Tachikawa (JP); Hiroshi Hashi, Tokyo (JP)

(73) Assignee: Olympus Optical Co., Ltd., Tokyo (JP)

( * ) Notice: Subject to any disclaimer, the term of this patent is extended or adjusted under 35 U.S.C. 154(b) by 133 days.

(21) Appl. No.: 09/910,739

(22) Filed: Jul. 23, 2001

(65) Prior Publication Data

US 2002/0018097 A1 Feb. 14, 2002

(30) Foreign Application Priority Data

Jul. 26, 2000 (JP) ..... 2000-225654
Jun. 26, 2001 (JP) ..... 2001-193469

(51) Int. Cl.[7] ..... B41J 2/155
(52) U.S. Cl. ..... 347/42; 347/19; 347/30
(58) Field of Search ..... 347/42, 13, 30, 347/19, 14, 31, 32, 33, 8

(56) References Cited

U.S. PATENT DOCUMENTS 5,040,000 A * 8/1991 Yokoi ..... 347/30
6,155,669 A * 12/2000 Donahue et al. ..... 347/42
6,328,418 B1 * 12/2001 Yamada et al. ..... 347/40
6,386,668 B1 * 5/2002 Shimizu et al. ..... 347/13

FOREIGN PATENT DOCUMENTS

JP 2000-351467 A 12/2000

* cited by examiner

*Primary Examiner*—Lamson Nguyen
(74) *Attorney, Agent, or Firm*—Frishauf, Holtz, Goodman & Chick, P.C.

(57) ABSTRACT

A printer comprises a transportation belt, a printer head, and a pneumatic paper sucker. The transportation belt is driven by a driving roller that drives a driven roller. The printer head includes a plurality of head units each having ink-jet surfaces. In the printer, print paper is adsorbed to the transportation belt by the sucker, and transported in a direction of transportation. Ink drops jetted out from the head units are shot at correct points on the print paper specified in print data. Thus, printing is achieved. According to the printer, the printer head need not be shifted in the process of printing, but printing can be achieved at a high speed. Moreover, the costs of manufacturing can be reduced, and the printer can be designed compactly.

10 Claims, 27 Drawing Sheets

PRINTER

This application claims benefit of Japanese Applications No. 2000-225654 filed in Japan on Jul. 26, 2000 and No. 2001-193469 filed in Japan on Jun. 26, 2001, the contents of which are incorporated by this reference.

BACKGROUND OF THE INVENTION

1. Field of the Invention

The present invention relates to the structure of a printer that jets out ink drops from a plurality of nozzles for the purpose of printing.

2. Description of the Related Art

Existing printers marketed as consumer goods include an inkjet printer that jets out droplets of ink from a plurality of nozzles. A typical type of inkjet printer is a head shift type that has a head shifted in a direction of main scan (direction of the width of paper) for the purpose of printing. A printer head adapted to the head shift type printer includes a plurality of nozzles that are arranged in the same direction as a direction of sub scan (direction of paper feed) or a direction inclined relative to the direction of sub scan. The printer head is shifted in the direction of main scan in order to print paper over the entire width thereof.

Consequently, a displacing mechanism for displacing the printer head in the direction of main scan and a paper feed mechanism are needed as a feed driving mechanism. Therefore, the driving mechanism unit becomes complex and a higher printing speed is limited.

A full-line inkjet printer whose printer head need not be driven in the direction of main scan has been devised as a printer whose driving mechanism unit is simple and whose printing speed is high. The full-line inkjet printer has a full-line head that can print one line on paper in the direction of the width thereof, and achieves printing during one pass. Since one line in the width direction of paper is printed simultaneously, the head need not be shifted at all. Paper is transported in one direction intermittently or continuously, whereby printing is achieved line by line.

However, the aforesaid conventional full-line inkjet printer prints paper, of which width is 210 mm, during one pass. Assuming that a resolution the printer offers is 200 dpi, the printer needs as a printer head an elongated head on the surface of which ink-jet ports of nozzles of about 1600 channels are exposed. The elongated head is a product whose yield is poor and that is hard to manufacture.

Moreover, in the full-line inkjet printer, a printer head and paper or printer heads must maintain a precise positional relationship over the entire width of paper. The precise positional relationship must also be maintained in a direction in which the paper is transported. A paper holding mechanism, a paper transporting mechanism, and a printer head supporting mechanism are therefore needed to maintain the precise positional relationship.

Furthermore, there are problems that must be solved in terms of adjustment, maintenance, and management of a printer head that has, as mentioned above, numerous channels.

SUMMARY OF THE INVENTION

Accordingly, the present invention attempts to solve the foregoing problems. An object of the present invention is to provide a printer that jets out ink drops from a plurality of nozzles for the purpose of printing. In the printer, a high printing speed is attained, the costs of manufacturing can be reduced, and a compact design can be realized. Moreover, adjustment, maintenance, and management are simplified.

A printer in accordance with the present invention jets out ink drops from a plurality of nozzles for the purpose of printing. The printer consists mainly of a printer head, a transportation belt, and a printing control means. The printer head can print one full line on print paper without the necessity of being shifted in the direction of the width of the print paper. The printer head includes the plurality of nozzles. The transportation belt is an endless belt member, holds the print paper, and transports the print paper in a direction orthogonal to the width direction of the print paper. In the printer, the printing control means controls jetting of ink drops from the printer head synchronously with transportation of the print paper by the transportation belt. Thus, printing is achieved.

Another printer in accordance with the present invention jets out ink drops from a plurality of nozzles for the purpose of printing. The printer consists mainly of a printer head, a transportation belt, and a printing control means. The printer head can print one full line on print paper without the necessity of being shifted in the direction of the width of the print paper, and includes the plurality of nozzles. The transportation belt is an endless belt member, holds the print paper, and transports the print paper in a direction nearly orthogonal to the width direction of the print paper. In the printer, the printing control means controls the timing of jetting out ink from the nozzles according to a variation of an ink-jet distance, that is, a distance between the print paper, which is held on the transportation belt, and an ink-jet surface included in the printer head. This is intended to shoot the ink drops at correct points on the print paper synchronously with transportation of the print paper by the transportation belt. Printing is thus achieved.

Still another printer in accordance with the present invention jets out ink drops from a plurality of nozzles for the purpose of printing. The printer consists mainly of a printer head, a transportation belt, and a printing control means. The printer head can print one full line on print paper without the necessity of being shifted in the direction of the width of the print paper, and includes the plurality of nozzles. The transportation belt is an endless belt member, holds the print paper, and transports the print paper in a direction orthogonal to the width direction of the print paper. The printing control means controls jetting of ink drops from the printer head synchronously with transportation of the print paper by the transportation belt. In the printer, the transportation belt has a recovery area that is used to recover the ability of the printer head to jet out ink.

Still another printer in accordance with the present invention jets out ink drops from a plurality of nozzles for the purpose of printing. The printer consists mainly of a printer head, a transportation belt, a drying means, and a printing control means. The printer head can print one full line on print paper without the necessity of being shifted in the direction of the width of the print paper, and includes the plurality of nozzles. The transportation belt is an endless belt member, holds the print paper, and transports the print paper in a direction orthogonal to the width direction of the print paper. The drying means dries ink shot on the print paper. In the printer, the printing control means controls jetting of ink drops from the printer head synchronously with transportation of the print paper by the transportation belt.

The other features of the present invention and the advantages thereof will be apparent from the description below.

DESCRIPTION OF THE PREFERRED EMBODIMENTS

Embodiments of the present invention will be described in conjunction with the drawings.

To begin with, a printer in accordance with a first embodiment of the present invention will be described in conjunction with FIG. 1 to FIG. 7A and FIG. 7B.

Figure 1:
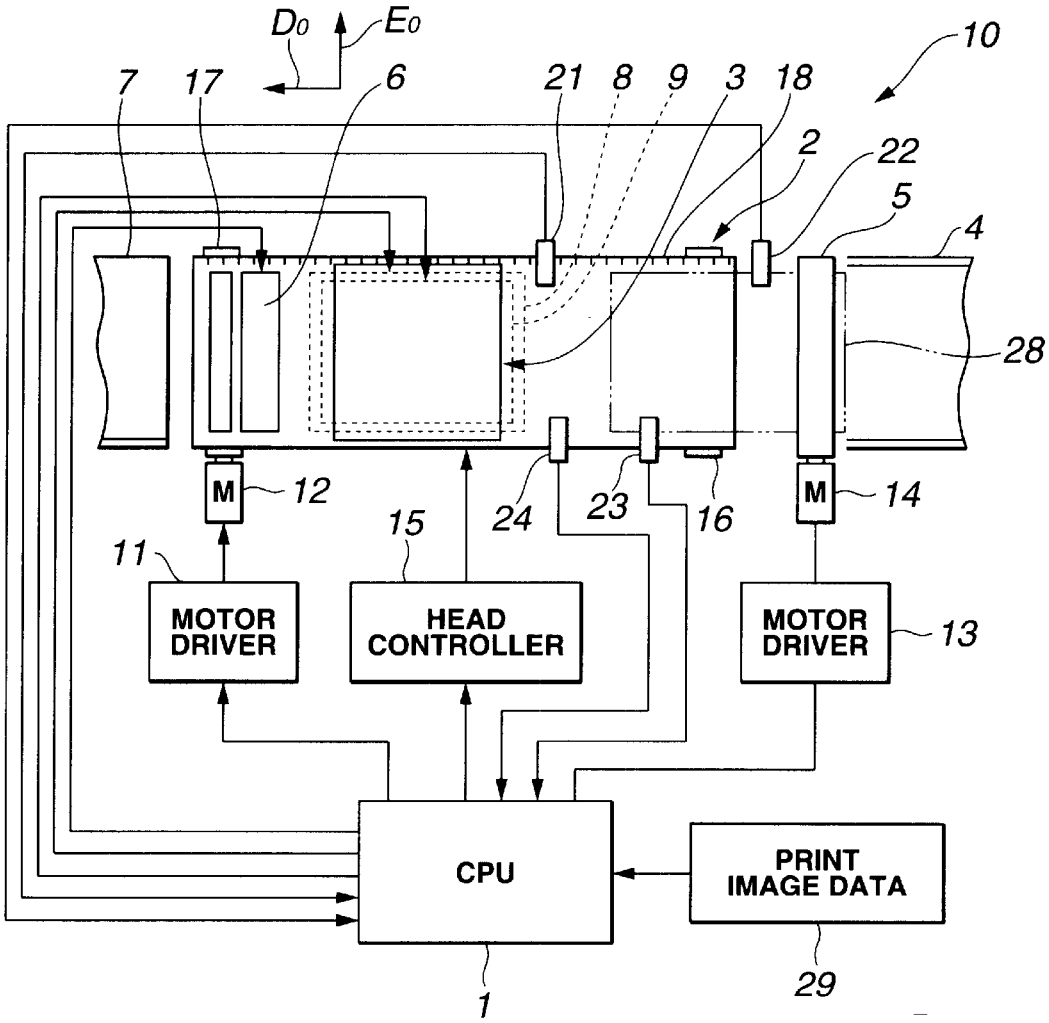
FIG. 1 shows a system configuration of a printer in accordance with a first embodiment of the present invention.
Figure 2:
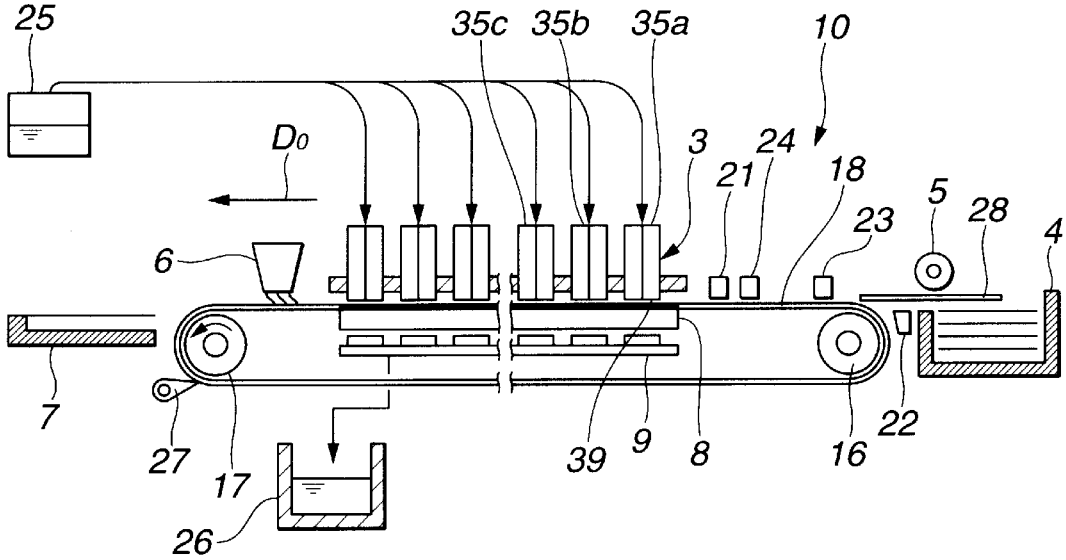
FIG. 2 is a longitudinal sectional view schematically showing a printing mechanism and its surroundings included in the printer shown in FIG. 1.
Figure 3:
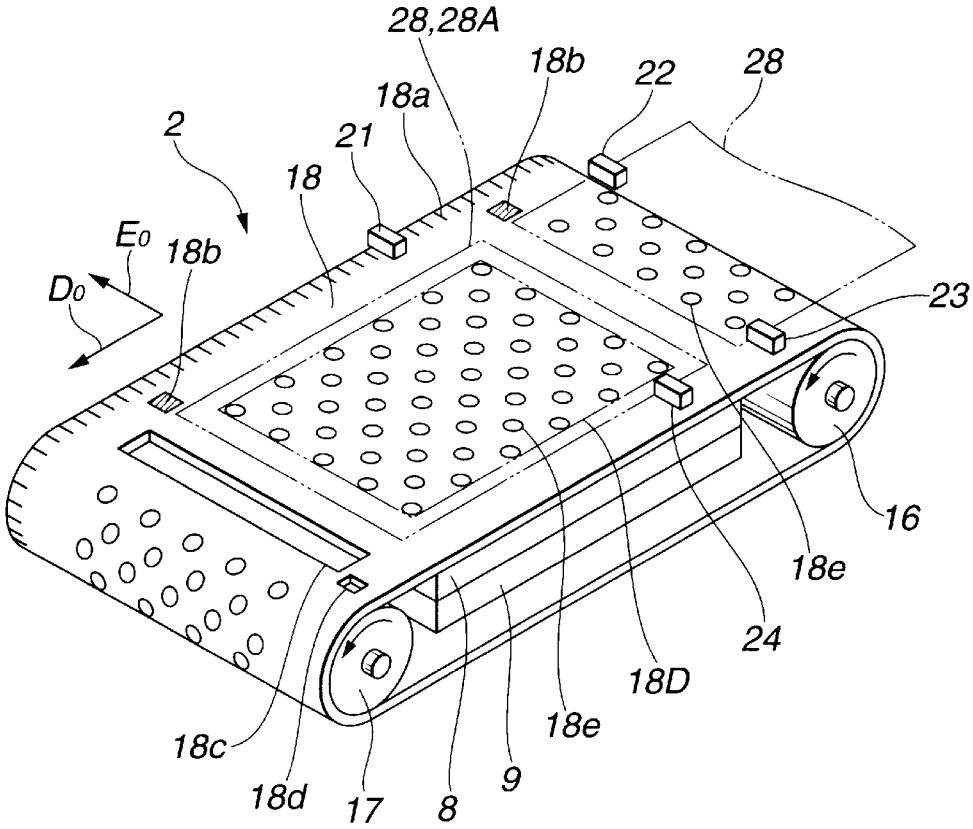
FIG. 3 is a perspective view showing the structure of a paper transportation system adapted to the printer shown in FIG. 1.
Figure 4:
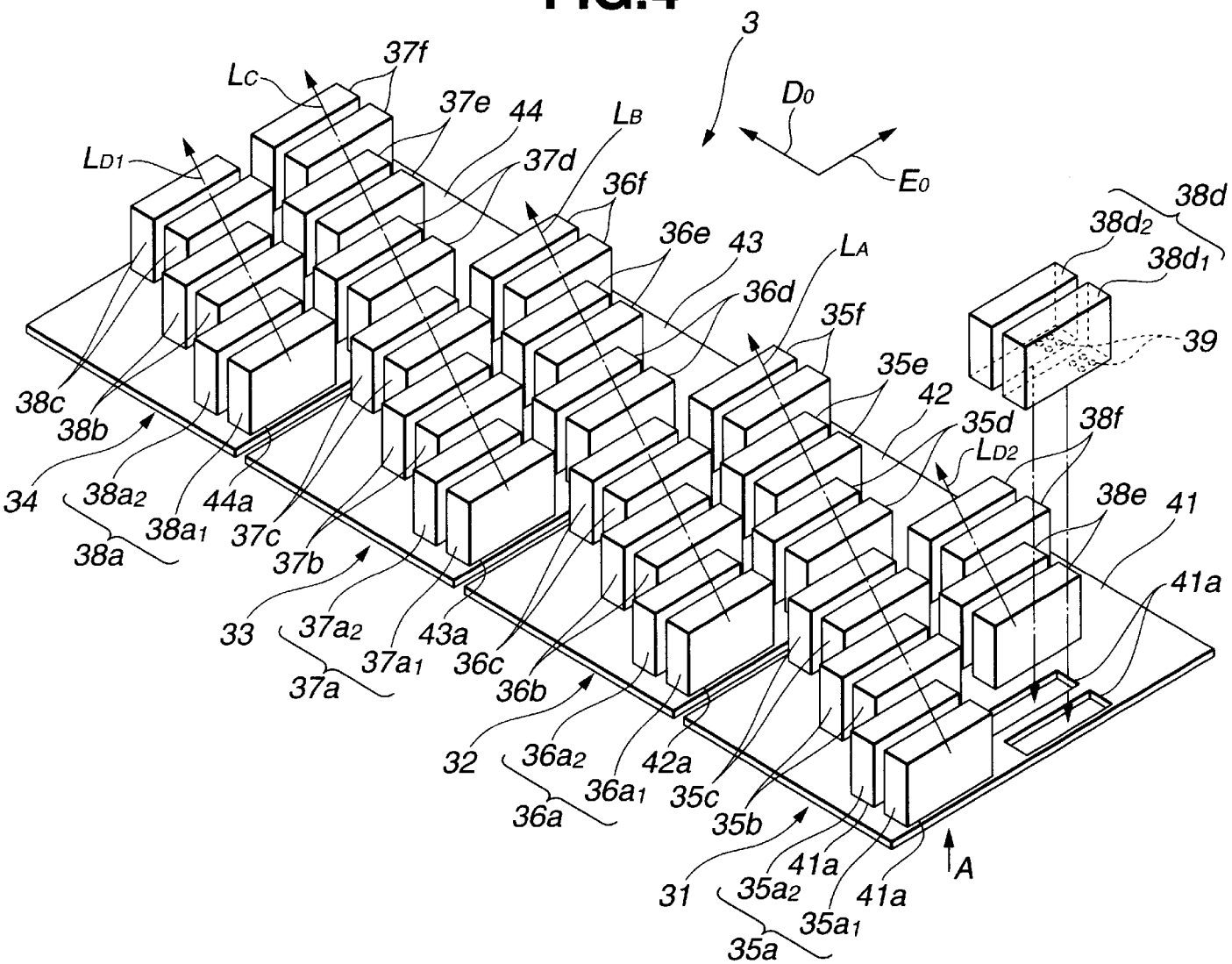
FIG. 4 is a perspective view showing the arrangement of members of a printer head adapted to the printer shown in FIG. 1.
Figure 5:
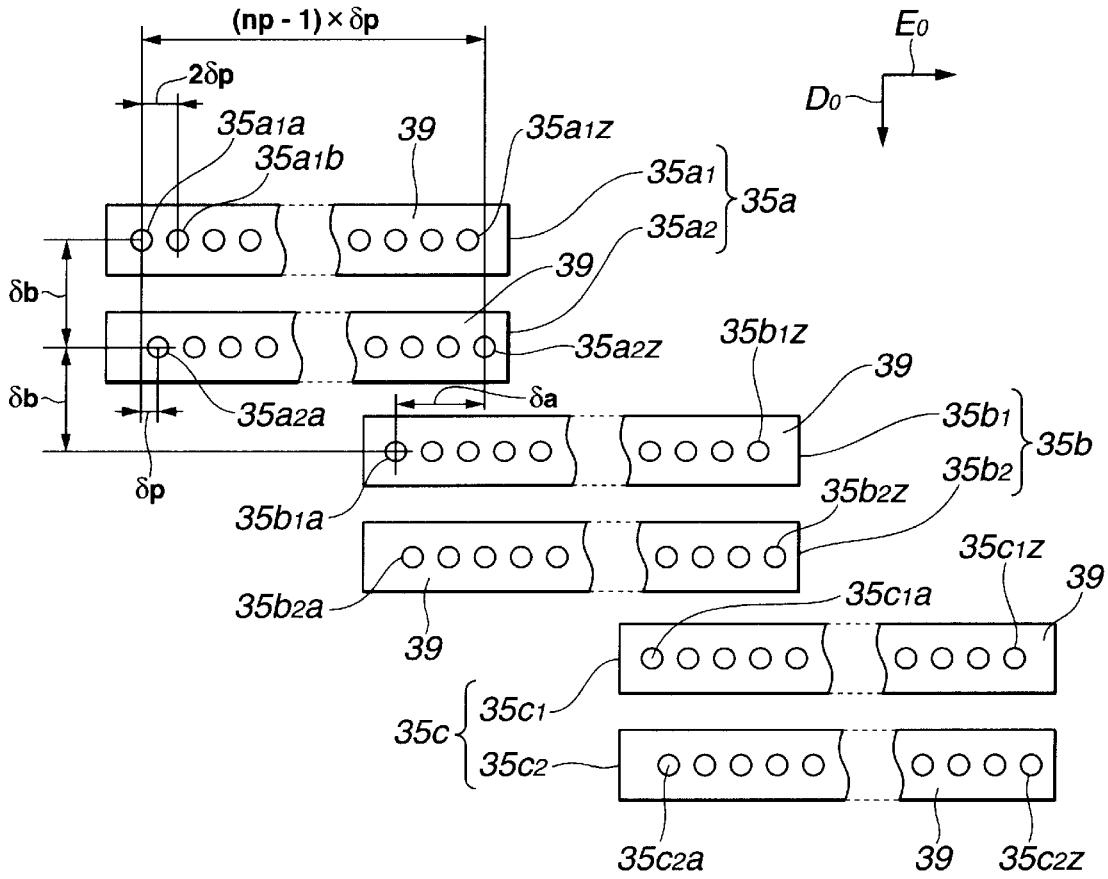
FIG. 5 is an enlarged view showing the arrangement of nozzles that are included in head units which constitute the printer head shown in FIG. 4 and that are seen from the side of ink-jet surfaces.
Figure 6:
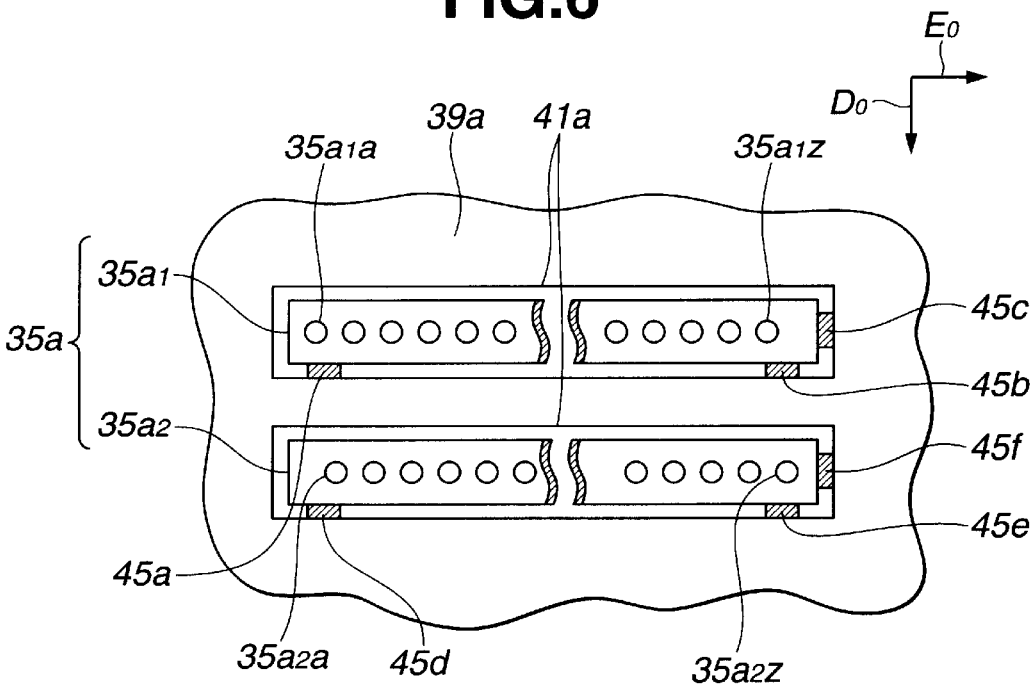
FIG. 6 is an enlarged view showing nozzles which are included in one of the head units that constitute the printer head shown in FIG. 4, of which positions have been adjusted, which are seen from the side of ink-jet surfaces.
Figure 7A:
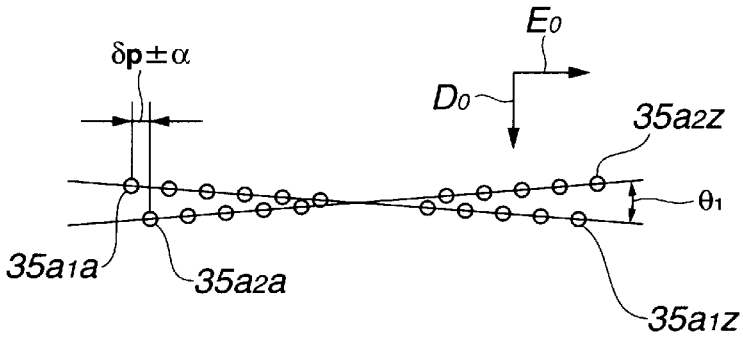
FIG. 7A is an enlarged view showing dots printed by the head unit shown in FIG. 6, in which the positions of the nozzles are unadjusted.
Figure 7B:
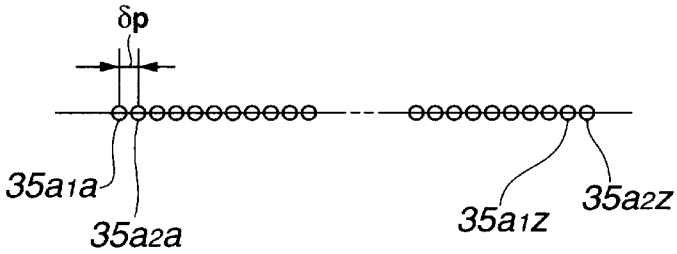
FIG. 7B is an enlarged view showing dots printed by the head unit shown in FIG. 6, in which the positions of the nozzles have been adjusted.

FIG. 1 shows a system configuration of a printer 10 in accordance with the first embodiment of the present invention. FIG. 2 is a longitudinal sectional view schematically showing a printing mechanism and its surroundings included in the printer 10 shown in FIG. 1. FIG. 3 is a perspective view showing the structure of a paper transportation system adapted to the printer shown in FIG. 1. FIG. 4 is a perspective view showing the arrangement of members of a printer head adapted to the printer 10 shown in FIG. 1. FIG. 5 is an enlarged view showing the arrangement of nozzles that are included in head units which constitute the printer head shown in FIG. 4 and that are seen from side A in FIG. 4 (from the side of inkjet surfaces). FIG. 6 is an enlarged view showing the nozzles that are included in one of the head units which constitute the printer head shown in FIG. 4, wherein the positions of the nozzles have been adjusted and the nozzles are seen from side A in FIG. 4. FIG. 7A is an enlarged view showing dots printed by the head unit shown in FIG. 6, in which the positions of the nozzles are unadjusted. FIG. 7B is an enlarged view showing dots printed by the head unit shown in FIG. 6, in which the positions of the nozzles have been adjusted.

The printer 10 in accordance with the first embodiment is an inkjet printer that jets out droplets of ink from a plurality of nozzles that cover the entire width of paper for the purpose of printing. The printer comprises a CPU 1, a paper transportation system 2, a printer head 3, a paper feed tray 4, a paper thrust roller 5, a drier 6, a paper discharge tray 7, a sucker 8, a recovering device 9, a drive motor (M) 12, a motor driver 11, a drive motor (M) 14, a motor driver 13, and a head controller 15. The CPU 1 serves as a printing control means that is responsible for control of the whole printer. The paper transportation system 2 includes a transportation belt 18 that transports paper. The printer head 3 jets out ink drops of four colors according to print image data. The paper feed tray 4 is used to feed print paper (hereinafter paper) 28. The paper thrust roller 5 serves as a paper positioning means. The drier 6 serves as a drying means of air heating type. Printed paper is stowed in the paper discharge tray 7. The sucker 8 serves as a sucking means that sucks the paper 28 aerially. The recovering device 9 serves as a recovering means that recovers the ability of the printer head 3 to jet out ink. The drive motor 12 drives a driving roller 17 that drives the paper transportation system 2. The motor driver 11 drives the motor 12. The drive motor 14 drives the paper thrust roller 5. The motor driver 13 drives the motor 14. The head controller 15 controls jetting of ink drops from the printer head 3.

The paper feed tray 4 is placed at an edge of the transportation belt 18 at which paper is fed. The paper thrust roller 5 is located at the exit of the paper feed tray 4. The drier 6 is located a position at which paper is discharged from the transportation belt 18. The paper discharge tray 7 is located at the other edge of the transportation belt 18 at which paper is discharged. The sucker 8 is located inside the transportation belt 18, and inserted to or withdrawn from a position at which the sucker 8 is opposed to the printer head 3 below the printer head 3. The recovering device 9 is placed below the sucker 8 inside the transportation belt 18.

The paper transportation system 2 comprises the transportation belt 18, the driving roller 17, a driven roller 16, a cleaning claw 27, and various sensors. The transportation belt 18 is an endless belt member. The driving roller 17 drives the transportation belt 18 in a direction of transportation (D0) orthogonal to the direction of the width of the paper 28 (E0). The cleaning claw 27 serves as a cleaning means that removes ink that has adhered to the transportation surface of the transportation belt. Incidentally, an ink suction roller or the like may be adopted as the cleaning means.

The transportation belt 18 has a group of intake holes 18*e*, a recovery opening 18*c*, mark lines 18*a*, and a paper tip position mark 18*b*. The group of intake holes 18*e* is used to adsorb the paper 28. The recovering device 9 is opposed to ink-jet surfaces 39 included in the printer head 3 through the recovery opening 18*c*. The mark lines 18*a* that are arranged at regular intervals serve as speed/position marks that are used to detect the traveling speed of the transportation belt 18 and the position of the distal edge of paper. The paper tip position mark 18*b* is a mark indicating the position of the distal edge of paper (serves as a paper positioning means).

The group of intake holes 18*e* is formed in an intake area 18D that is narrower than a paper area 28A in which the paper 28 is held. The paper tip position mark 18*b* is inscribed at a position that is determined in consideration of the position of a paper tip position sensor 22 so that the paper 28 can be positioned in the paper area 28A (see FIG. 3). The paper tip position sensor 22 that will be described later recognizes the distal edge of paper.

The paper transportation system 2 further includes a belt speed/position detection sensor 21, the paper tip position sensor 22, and two paper tilt detection sensors 23 and 24. The belt speed/position detection sensor 21 senses passage of the mark lines 18*a* so as to help detect the traveling speed of the transportation belt 18 and the position of the distal edge of paper. The paper tip position sensor 22 serves as a paper positioning means and detects passage of the paper tip position mark 18*b*. The paper tilt detection sensors 23 and 24 detect a tilt of the held paper 28 with respect to the direction D0 of transportation in a state where the paper 28 is held.

The printer head 3 is an inkjet type printer head, and composed of a plurality of head units 35*a*, 35*b*, etc. each of which has a group of piezoelectric devices that control ink jets and a row of ink-jet nozzles. Ink to be jetted out is supplied from an ink tank 25.

Next, the structure of the printer head 3 will be described in detail. FIG. 4 is a perspective view showing the arrangement of the members of the printer head. The printer head 3 comprises four head blocks 31, 32, 33, and 34 that are, as shown in FIG. 4, juxtaposed in the direction of transportation (direction D0). Each head block is composed of a bearing substrate and a plurality of trains of three head units that are borne by the bearing substrate and that are arranged stepwise with respect to the direction D0. Moreover, each printer unit comprises a pair of units each having a row of nozzles. The row-of-nozzles unit includes a piezoelectric device that jets out ink drops.

The head block 31 comprises the bearing substrate 41, head units 35*a*, 35*b*, and 35*c*, and head units 38*d*, 38*e*, and 38*f*. The head units are locked in openings 41*a* formed in the bearing substrate 41.

The head block 32 comprises a bearing substrate 42, head units 36*a*, 36*b*, and 36*c*, and head units 35*d*, 35*e*, and 35*f*. The head units are locked in openings 42*a* formed in the bearing substrate 42.

The head block 33 comprises a bearing substrate 43, head units 37*a*, 37*b*, and 37*c*, and head units 36*d*, 36*e*, and 36*f*. The head units are locked in openings 43*a* formed in the bearing substrate 43.

The head block 34 comprises a bearing substrate 44, head units 38*a*, 38*b*, and 38*c*, and head units 37*d*, 37*e*, and 37*f*. The head units are locked in openings 44*a* formed in the bearing substrate 44.

The head units 35*a*, 35*b*, 35*c*, 35*d*, 35*e*, and 35*f* divided into the head block 31 and head block 32 jet out ink of black (B), and are arranged along a single oblique line LA that is inclined with respect to the direction D0.

The head units 36*a*, 36*b*, 36*c*, 36*d*, 36*e*, and 36*f* divided into the head block 32 and head block 33 jet out ink of yellow (Y), and are arranged along a single oblique line LB that is inclined with respect to the direction D0.

The head units 37*a*, 37*b*, 37*c*, 37*d*, 37*e*, and 37*f* divided into the head block 33 and head block 34 jet out ink of magenta (M), and are arranged along a single oblique line LC that is inclined with respect to the direction D0.

The head units 38*a*, 38*b*, 38*c*, 38*d*, 38*e*, and 38*f* divided into the head block 34 and head block 31 jet out ink of cyan (C), and are arranged along two oblique lines LD1 and LD2 that are inclined with respect to the direction D0.

The groups of head units associated with colors and arranged along the oblique lines LA, LB, LC, LD1, and LD2 on the head blocks are not limited to the foregoing ones. Alternatively, groups of head units associated with colors that are different from the above colors may be arranged along the oblique lines LA, LB, LC, LD1 and LD2.

The printer head 3 has the plurality of head units, which are associated with different colors, arranged along the oblique lines LA, LB, LC, LD1, and LD2 that meet the direction D0 at a predetermined inclination. The nozzles of the head units have a predetermined pitch between adjoining ones. For example, the head units 35*a*, 35*b*, 35*c*, 35*d*, 35*e*, and 35*f* are arranged so that ink-jet nozzles included in the two rows-of-nozzles units constituting each head unit will have a predetermined pitch δp in the direction E0 that is the direction of the width of the paper 28 (the effective width of paper of size A4 is 210 mm). Noted is that a pitch between nozzles included in opposed portions of head units is not equal to δp. In the direction D0, the ink-jetg nozzles are arranged along the oblique line LA that forms a predetermined inclination with respect to the direction D0. The pitch δp is, for example, 0.0635 mm on the assumption that the printer offers a resolution of 400 dpi.

FIG. 5 is an enlarged view showing three head units that are part of the head units mounted on the head blocks and that are seen from the side of ink-jet surfaces 39. For example, the head unit 35*a* on the head block 31 comprises a pair of row-of-nozzles units 35*a*1 and 35*a*2 each having a row of nozzles. The head unit 35*b* comprises a pair of row-of-nozzles units 35*b*1 and 35*b*2 each having a row of nozzles. The head unit 35*c* comprises a pair of row-of-nozzles units 35*c*1 and 35*c*2 each having a row of nozzles. Moreover, a distance in the direction D0 between the centerlines of row-of-nozzles units is δb. The row-of-nozzles units included in different head units are also separated from each other in the direction D0 with the distance δb between the centerlines thereof.

On the ink-jet surface 39 of one of the paired row-of-nozzles units, that is, the row-of-nozzles unit 35*a*1, the ink-jet ports of np/2 nozzles 35*a*1*a*, 35*a*1*b*, etc., and 35*a*1*z* are exposed in the direction E0 with a pitch 2δp between adjoining nozzles. On the ink-jet surface 39 of the other row-of-nozzles unit 35*a*2, the ink-jet ports of np/2 nozzles 35*a*2*a*, etc., and 35*a*2*z* are exposed with the pitch 2δp between adjoining nozzles. The nozzles 35*a*2*a*, etc., and 35*a*2*z* are deviated from the nozzles 35*a*1*a*, etc., and 35*a*1z by a distance δp. Consequently, the heat unit 35*a* composed of a pair of row-of-nozzles units 35*a*1 and 35*a*2 can be said to have np nozzles, which create np dots, arranged at a pitch δp between adjoining nozzles.

Assuming that the head unit 35*b* is positioned after the head unit 35*a* is, and that the head unit 35*c* is positioned after the head unit 35*b* is, the head units are arranged so that the centerline of one row-of-nozzles unit included in one head unit will be separated by the distance δb in the direction D0 from the centerline of an opposed row-of-nozzles unit included in an opposed head unit. Moreover, nozzles included in opposed row-of-nozzles units of opposed head units alternate over a distance δa in the direction D0. The distance δa over which the nozzles included in opposed row-of-nozzles units alternate is equivalent to δa/δp print dots. Furthermore, the head unit 35*d* on the head block 32 is positioned to have a similar positional relationship to the head unit 35*c*. Likewise, the head unit 35*e* is positioned to have the similar positional relationship to the head unit 35*d*, and the head unit 35*f* is positioned to have the similar positional relationship to the head unit 35*e*. The distance δa over which the nozzles included in opposed row-of-nozzles units alternate signifies a distance between the rightmost nozzle in one row-of-nozzles unit included in the head unit 35*a* and the leftmost nozzle in one row-of-nozzles unit included in the head unit 35*b*. In other words, the leftmost nozzle in the row-of-nozzles unit included in the head unit 35*b* is separated from the rightmost nozzle in the row-of-nozzles unit included in the head unit 35*a* by a distance smaller than a distance equivalent to one dot in a direction opposite to the direction E0.

A print dot created with ink jetted out from one nozzle included in one row-of-nozzles unit of each head unit and a print dot created with ink jetted out from another nozzle that is included in the other row-of-nozzles unit thereof and that adjoins the above nozzle in the direction E0 (for example, nozzles 35*a*1*a* and 35*a*2*a*) may be, as shown in FIG. 7A, separated from each other by a minute dimension α in the direction E0. FIG. 7A is an enlarged view showing dots created with the positions of row-of-nozzles units unadjusted. Besides, a row of print dots created with ink jetted out from one rwo-of-nozzles unit and a row of print dots created with ink jetted out from the other row-of-nozzles unit may be deviated from each other in the direction D0 and may meet at an inclination θ1. In this case, at the time when the row-of-nozzles units are mounted, the positions of the row-of-nozzles units are finely adjusted using shims.

When the positions of row-of-nozzles units have to be finely adjusted using shims, shims 45*c* and 45*f* are inserted to the right ends of the openings 41*a* formed in the substrate in order to adjust the positions in the direction E0 of the row-of-nozzles units. In order to correct the deviation in the direction D0 and the inclination, shims 45*a* and 45*b* or shims 45*d* and 45*e* are inserted or fitted in the gap between the opening 41*a* and row-of-nozzles unit. FIG. 7B is an enlarged view showing dots printed with a head unit whose row-of-nozzles units have the positions thereof adjusted.

The recovering device 9 is a device that performs recovering, that is, recovers the ability of the printer head 3 to jet out ink drops from the ink-jet surfaces 39 on each of which the ink-jet ports of a row of nozzles are exposed. For example, the recovering device 9 resolves clogging. Prior to recovering, the sucker 8 is withdrawn in order to move the transportation belt 18. When the recovery opening 18*c* of the transportation belt 18 comes to face each head unit, ink is jetted out from the nozzles included in the opposed head unit in order to clean the ink-jet surface of the head unit. The jetted ink is routed to a waste fluid tank 26 and reserved therein (see FIG. 2). Incidentally, the opening 18*c* of the transportation belt 18 serves as an ink-jet area through which ink is jetted out during recovering. Paper is therefore not sucked through the opening 18*c*.

The CPU 1 fetches outputs of the various sensors so as to control the paper transportation system 2 using the motor drivers 11 and 13. The CPU 1 also fetches print image data 29 and uses the head controller 15 to control ink jets from the head units. Moreover, the CPU 1 controls recovering to be performed by the recovering device 9.

The actions to be performed in the thus configured printer 10 will be described below.

At first, recovering is performed in order to recover the ink-jet surfaces included in the printer head 3 under the control of the CPU 1 prior to start of printing. During the recovering, the sucker 8 is withdrawn to a position of withdrawal, and the transportation belt 18 devoid of paper is driven to travel. While the transportation belt 18 is traveling, the opening 18*c* of the transportation belt 18 comes to face each of the head units 35*a* to 35*f*, 36*a* to 36*f*, 37*a* to 37*f*, and 38*a* to 38*f*. At this time, ink is jetted out from the opposed head unit for the purpose of recovery. Clogging is resolved by jetting out ink and thus the ability of jetting out ink is recovered. The jetted ink is absorbed via the recovering device 9 and reserved in the waste fluid tank 26.

Thereafter, while the belt speed/position sensor 21 detects passage of the mark lines 18*a* inscribed on the transportation belt 18, and the transportation belt 18 is driven at a constant speed. When the paper tip position sensor 22 detects passage of the paper tip position mark 18*b* inscribed on the transportation belt 18, the paper thrust roller 5 is actuated in order to thrust the paper 28 to the paper area 28A on the transportation belt 18. The paper 28 is held in the paper area 28A while being sucked by the sucker 8 through the group of intake holes 18*e*. The paper 28 is then transported in the direction D0 together with the transportation belt 18. These actions are performed to transport paper under the control of the CPU 1.

The belt speed/position sensor 21 detects how many mark lines 18*a* paper has passed since passage of the paper tip position mark 18*b* was detected. When it is detected that the distal edge of the paper 28 has come to lie underneath the printer head 3, printing is started while being synchronized with movement of the paper in the direction D0 that is a direction of paper feed in which paper moves together with the transportation belt 18. Specifically, the head controller 15 performs control actions to control jetting of ink drops of each color from the nozzles of the printer head 3 according to the print image data 29 over the width of the paper. Printing is thus achieved. These actions are performed under the control of the CPU 1. Incidentally, the print head 3 is not shifted during the printing.

If the belt speed/position sensor 21 should recognize a change in the speed of the transportation belt 18 during printing, the head controller 15 adjusts the timing of jetting out ink drops from the nozzles of each head unit. The printing is therefore continued normally.

Moreover, if the paper tilt detection sensors 23 and 24 detect a tilt of the paper 28 that is held (oblique advancement), the timing of jetting out ink drops from the nozzles of each head unit is controlled based on the tilt of the paper. Points on the paper to which the ink drops are shot are thus adjusted. However, if the tilt of the paper is detected to be equal to or larger than a predetermined magnitude, jetting out the ink drops is suspended in order to stop printing.

After the printing is executed, the drier 6 dries ink. Thereafter, the sucking force exerted by the sucker 8 is extinguished, and the paper 28 is stowed in the paper discharge tray 7.

The printer head 3 has the head units thereof arranged as described in conjunction with FIG. 5 showing the arrangement of the nozzles. Specifically, the nozzles included in opposed row-of-nozzles units of head units alternate over the predetermined distance in the direction E0 that is the direction of the width of paper. The ink jets from the alternating nozzles overlap one another. This results in an image that is partly darker than original image data. For this reason, correction that will be described later is performed on the ink jets from the alternating nozzles, so that a copy image devoid of conspicuous lines caused by the opposed head units will be produced with the same density as the print image data.

According to the aforesaid printer 10 of the first embodiment, unlike conventional inkjet printers, the printer head need not be shifted in the direction E0 (direction of main scan). The paper 28 can therefore be transported quickly. This results in a higher printing speed, and obviates the necessity of a mechanism for driving the printer head in the direction E0. Consequently, the printer has a simple mechanism unit, and becomes compact and lowcost.

Moreover, an elongated continuous printer head is not adopted as the printer head, but a plurality of head units is used to form the printer head 3 capable of printing paper over the width of paper. The printer can therefore be manufactured easily, and the components can be assembled and adjusted easily.

In the printer head 3, the head units associated with one color are arranged along the oblique line LA that is inclined relative to the direction D0. Therefore, the timing of allowing nozzles to jet out ink drops can be controlled simply in the course of controlling jetting of ink drops.

The endless transportation belt 18 that is driven using the driving roller is adopted instead of a platen roller and included in the paper transportation system. The transportation mechanism is therefore not complex but the printer can be designed compactly. Moreover, since the driving roller 17 is located downstream in the direction of transportation, the transportation belt that transports the paper is always highly tensed but does not sag. Consequently, the paper is transported highly precisely.

The pneumatic sucker 8 is adopted in order to hold paper in a predetermined place. Paper is therefore hardly displaced, and a printed point is hardly deviated from a right point. Moreover, the group of intake holes 18*e* is formed in the intake area 18D on the transportation belt 18, and the intake area 18D is narrower than the paper area 28A. No intake hole is formed outside the paper area. Therefore, air causing ink jets will not be disturbed, the directions of ink jets will not be varied, but printing can be achieved highly precisely.

Incidentally, the technology of correcting ink jets to correct inhomogeneous print density caused by the alternating nozzles is described in Japanese Unexamined Patent Publication No. 2000-168109 (U.S. patent application Ser. No. 09/442,417 filed on Nov. 18, 1999) filed previously by the present applicant.

In the printer head 3 adapted to the printer 10 of the present embodiment, a composite-color block having head units, which are associated with a plurality (two) of colors, mounted thereon is adopted. As a variant of the printer head 3, single-color blocks each having a plurality of head units, which is associated with a single color, mounted thereon may be combined in order to construct a multicolor printer head.

Figure 8:
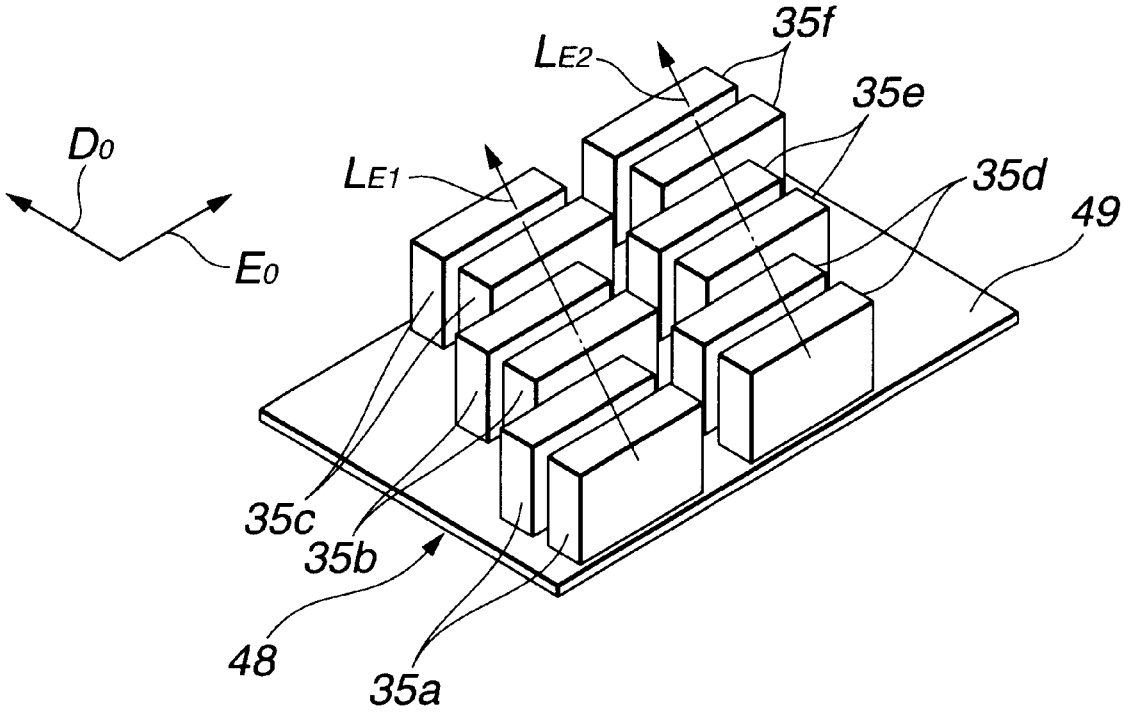
FIG. 8 is a perspective view showing a black head block that is employed in a variant of the printer head (head block) adapted to the printer in accordance with the first embodiment shown in FIG. 1.

FIG. 8 is a perspective view of a black head block 48 that is a single-color head block adapted to the printer head of the variant. On the black head block 48, black head units 35*a*, 35*b*, and 35*c* are arranged along an oblique line LE1 that is inclined relative to the direction D0. Black head units 35*d*, 35*e*, and 35*f* are arranged along an oblique line LE2 that is inclined relative to the direction D0. The head units are mounted on a head substrate 49.

The head units 35*a*, 35*b*, and 35*c*, and the head units 35*d*, 35*e*, and 35*f* have the relative positional relationships that cause the nozzles thereof to be arranged as described in conjunction with FIG. 5. However, the head units 35*a* and 35*d* are placed so that the nozzles thereof will be lined along the edge of the block that extends in the direction E0. Furthermore, the distance over which nozzles included in opposed portions of the head units 35*c* and 35*d* mounted on different blocks alternate in the direction E0 is identical to the distance ba described in conjunction with FIG. 5. The present variant has been described in relation to the black head block. The same applies to head blocks associated with the other colors.

According to the printer head of the present variant, the head blocks constituting the printer head are associated with single colors. For example, color-by-color ink drop jetting, recovering, and sucking can be achieved and controlled easily.

Next, a description will be made of variants, each of which includes the paper sucker, of the paper transportation system included in the printer 10 in accordance with the first embodiment.

Figure 9:
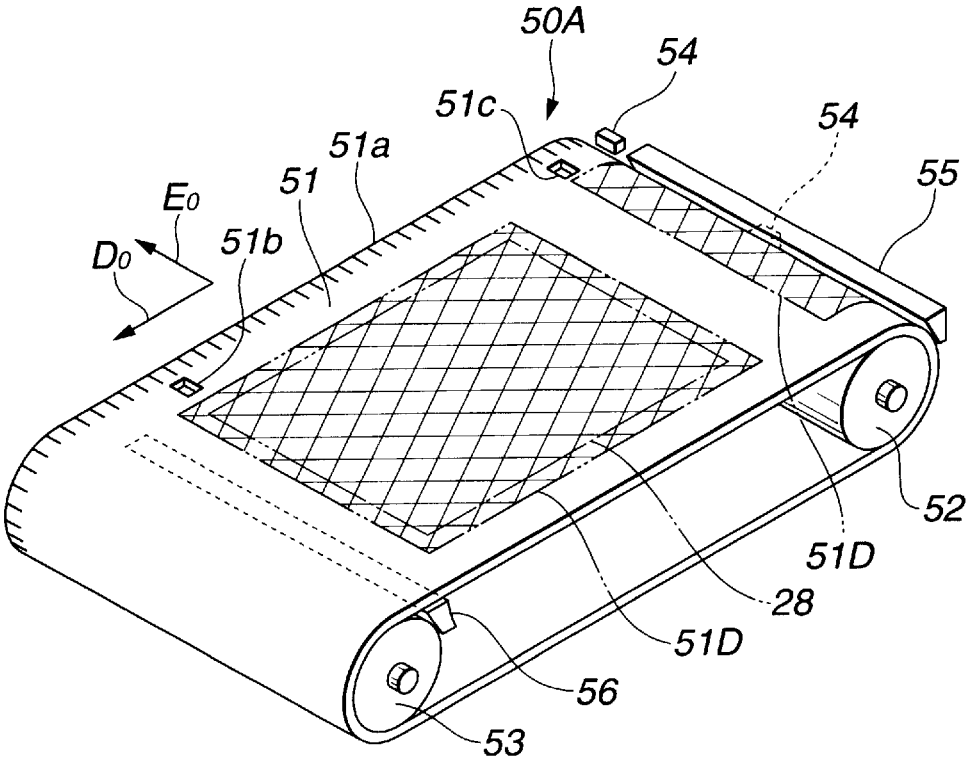
FIG. 9 is a perspective view showing a variant, which includes a paper sucker, of a paper transportation system employed in the printer in accordance with the first embodiment shown in FIG. 1.

FIG. 9 is a perspective view of a paper transportation system 50A that is one of the variants. The paper transportation system 50A of the present variant comprises a transportation belt 51, a driving roller 53, a driven roller 52, a paper tip position sensor 54, a charger 55, and a discharger 56. The transportation belt 51 for transporting paper is an endless belt and made mainly of an electrification material. The driving roller 53 is used to drive the transportation belt. The paper tip position sensor 54 detects passage of a paper tip position mark 51*b*. The charger 55 serves as a paper sucking means and is placed upstream outside the transportation belt 51. The discharger 56 is placed downward inside the transportation belt 51.

The transportation belt 51 bears speed detection mark lines 51*a* and the paper tip position mark 51*b*. Moreover, a discharging brush may be adopted as the discharger 56 and placed on the side of the face of the transportation belt 51. Moreover, the paper tip position sensor 54 may be located in the middle of the width of the transportation belt 51. Moreover, the other components of a printer to which the paper transportation system 50A is adapted are identical to those of the printer 10 in accordance with the first embodiment.

In the printer to which the paper transportation system 50A is adapted, the transportation belt 51 is driven in order to start printing. When the paper tip position sensor 54 detects passage of the paper tip position mark 51*b*, paper is thrust from the paper feed tray (not shown), by the paper thrust roller. At the same time, the charger 55 electrifies a paper holding electrification area 51D on the face of the transportation belt 51. Incidentally, a area in which the paper 28 is held is smaller than the electrification area 51D.

When the paper 28 moves in the direction D0, printing is completed duly. When the paper 28 reaches the downstream end of the transportation belt 51, a metallic brush included in the discharger 56 discharges the electrification area 51D. Consequently, the paper 28 is discharged. These control actions are performed to transport paper under the control of the CPU 1.

When the paper transportation system 50A of the present variant is adopted, a sucker that adsorbs paper by sucking air becomes unnecessary. The printer can be designed compactly and become small-sized.

Figure 10:
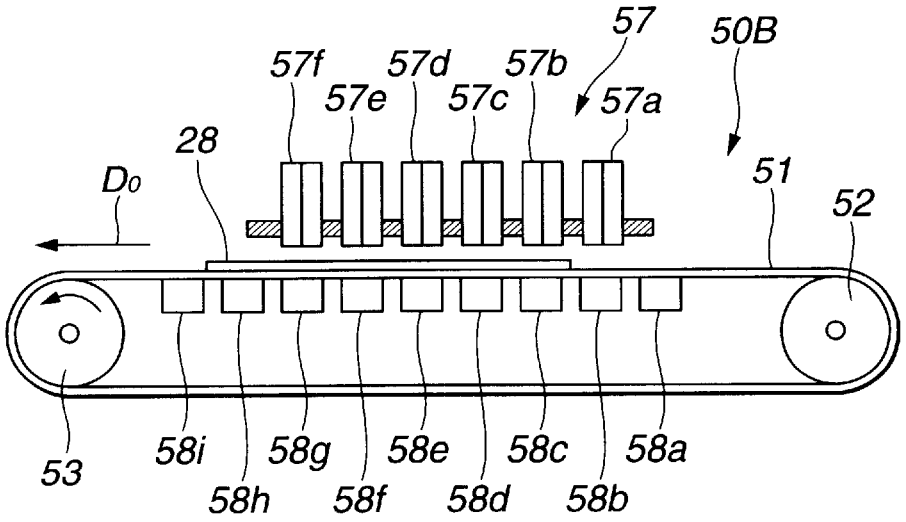
FIG. 10 is a longitudinal sectional view showing another variant, which includes a paper sucker, of the paper transportation system employed in of the printer in accordance with the first embodiment shown in FIG. 1.

FIG. 10 is a longitudinal sectional view of a paper transportation system 50B of another variant that includes a paper sucker. The paper transportation system 50B of the present variant comprises a transportation belt 51, a driving roller 53, a driven roller 52, air suction units 58*a*to 58*i*, and various sensors that are not shown. The transportation belt 51 for transporting paper is an endless belt and made of an electrification material. The driving roller 53 drives the transportation belt. The air suction units 58*a* to 58*i* mutually independently serve as a paper sucking means and are juxtaposed in the direction D0 (direction of transportation) inside the paper transportation surface of the transportation belt 51.

A printer head 57 composed of head units 57*a* to 57*f*, which are arranged in the direction D0 (direction of transportation) is placed above the transportation belt 51. The other components of a printer to which the paper transportation system 50B is adapted are identical to those of the printer 10 in accordance with the first embodiment.

In the printer to which the paper transportation system 50B is adapted, the fed paper 28 is transported by the transportation belt 51 during printing. While the paper is being transported by the belt, some of the air suction units 58*a* to 58*i* that overlie the paper 28 are selected and sequentially energized to suck the paper. The paper is thus adsorbed to the transportation belt 51. After the paper 28 has passed, the air suction units currently lying outside the paper are sequentially de-energized not to suck paper. These control actions are performed to transport paper under the control of the CPU 1.

According to the paper transportation system 50B of the present variant, an amount of air to be taken in for sucking paper can be reduced. This leads to a reduction in the capacity of a suction pump.

Figure 11:
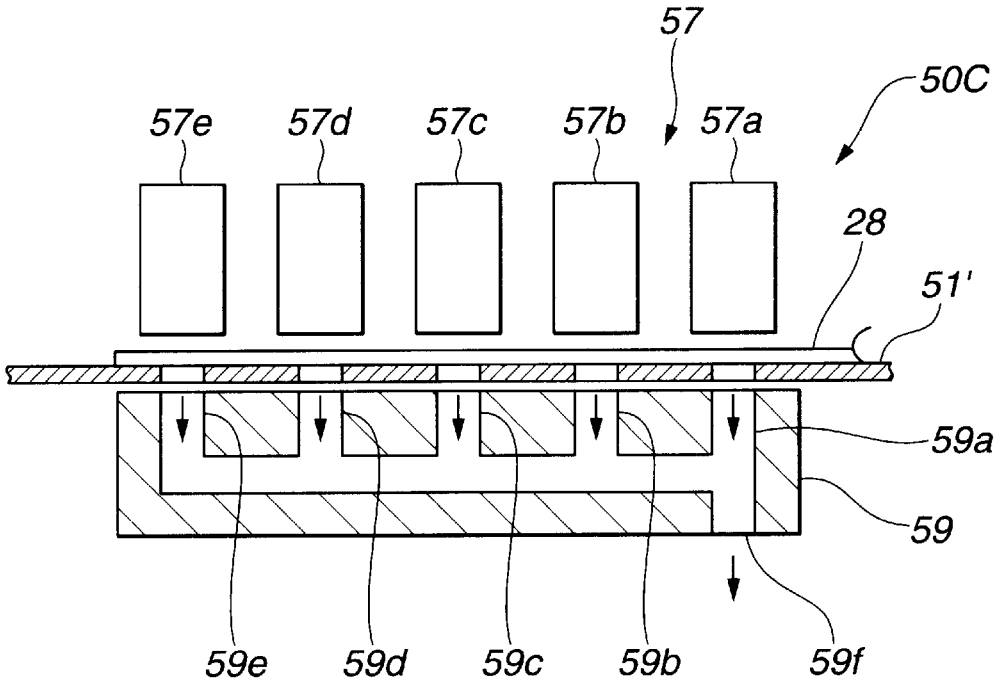
FIG. 11 is a longitudinal sectional view showing part of another variant, which includes a paper sucker, of the paper transportation system employed in the printer in accordance with the first embodiment shown in FIG. 1.

FIG. 11 is a longitudinal sectional view showing part of a paper transportation system 50C of another variant that includes a paper sucker. The paper transportation system 50C of the present variant comprises a transportation belt 51', a driving roller and a driven roller (not shown), various sensors (not shown), and a sucker 59. The transportation belt 51' for transporting paper is an endless belt. The sucker 59 is a paper sucking means that utilizes air suction, and is located inside the inner surface of the transportation belt 51' opposite to the paper transportation surface thereof.

A printer head 57 having head units 57*a* to 57*e* arranged in series with one another in the direction D0 (direction of transportation) is placed above the transportation belt 51'. The other components of a printer to which the paper transportation system 50C is adapted are identical to those of the printer 10 in accordance with the first embodiment.

The sucker 59 has division openings 59*a* to 59*e* formed therein. The division openings 59*a* to 59*e* are opposed to the head units 57*a* to 57*e* respectively with the transportation belt 51' between them. For printing, air is sucked through the openings 59*a* to 59*e* in order to hold paper 28 on the transportation belt 51'.

According to the paper transportation system 50C of the present variant, the paper 28 can be held reliably below the head units.

Figure 12:
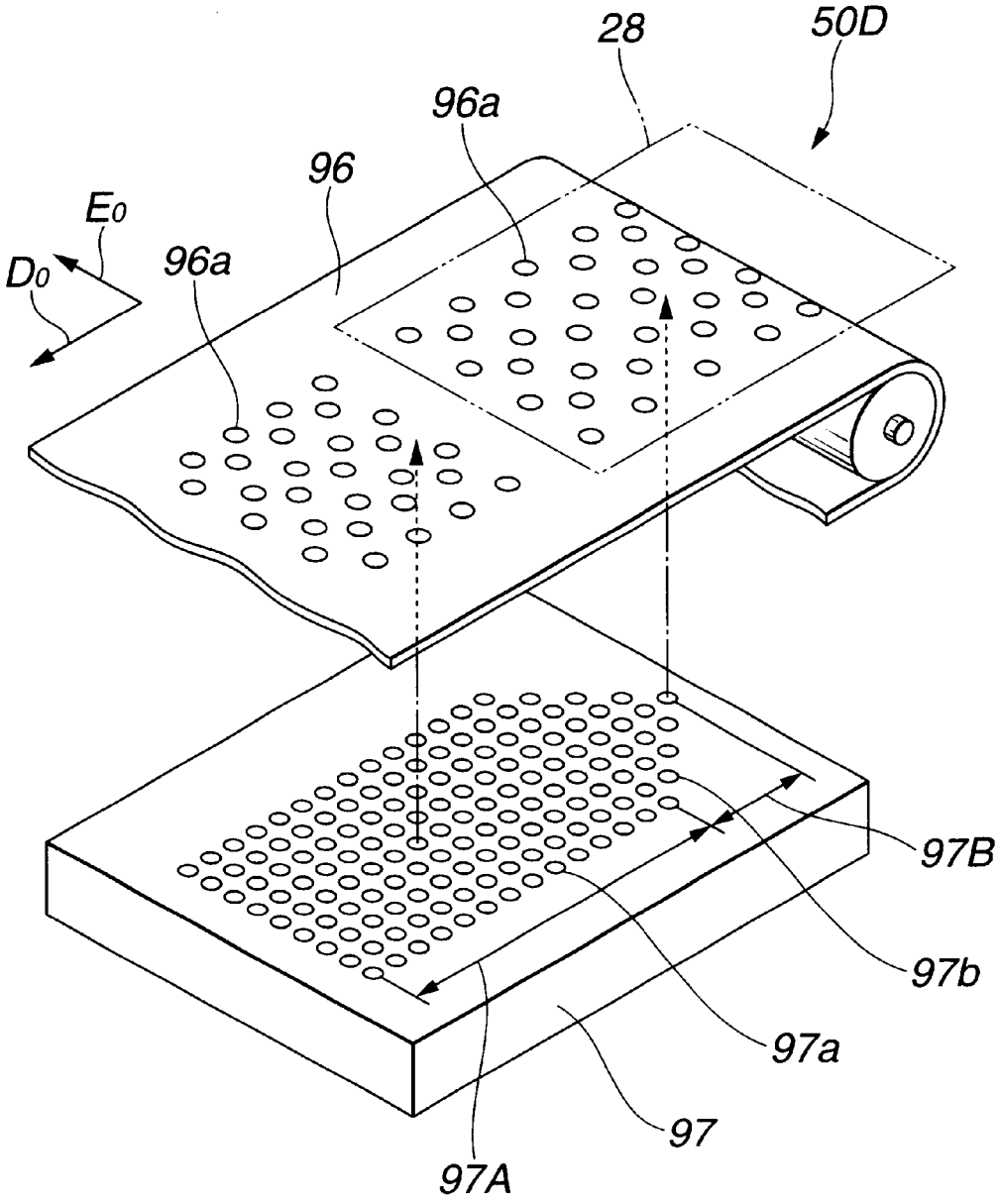
FIG. 12 is a partial perspective sectional view showing part of another variant, which includes a paper sucker, of the paper transportation system employed in the printer in accordance with the first embodiment shown in FIG. 1.

FIG. 12 is a perspective view showing part of a paper transportation system 50D of still another variant that includes a paper sucker. The paper transportation system 50D of the present variant comprises a transportation belt 96, a driving roller and a driven roller, various sensors, and a sucker 97. The transportation belt 96 for transporting paper is an endless belt. The sucker 97 is a paper sucking means that utilizes air suction, and is located inside the inner surface of the transportation belt 97 opposite to the paper transportation surface thereof. The other components of a printer to which the paper transportation system 50D is adapted are identical to those of the printer 10 in accordance with the first embodiment.

The transportation belt 96 has a group of intake holes 96*a* formed all over each paper area on the transportation surface of the transportation belt 96 within which the paper 28 is held.

On the other hand, the sucker 97 has a group of intake holes 97*a* formed within a range 97A that falls within the paper area. The group of intake holes 97*a* is opposed to a printer head. Within a range 97B adjacent to the range 97A and located by the upstream side of the range 97A in the direction of transportation (at the paper supply edge), a group of intake holes 97*b* is formed in the form of a triangle whose apex faces the upstream edge.

In a printer to which the paper transportation system 50D is adapted, when the paper 28 is thrust by the paper thrust roller and transported by the transportation belt, the paper 28 is moved in the direction D0 together with the group of intake holes 96*a* formed in the transportation belt 96.

During a paper feed period, the paper 28 passes above the group of intake holes 97*b* formed in the form of a triangle on the sucker 97 (range 97B). In the process of passage, the paper 28 is sucked without a wrinkle or warp. This is because the sucking force is exerted first through the intake holes lined in the middle in the width direction among the group of intake holes 97*b* and then gradually through the other intake holes lined outside. Finally, the whole paper is sucked through the group of intake holes 97*a* within the range 97A, and transported. The paper is then printed by the printer head (not shown). These actions are performed under the control of the CPU 1.

According to the paper transportation system 50D of the present variant, the paper 28 is reliably held without a wrinkle or warp, and transported.

Figure 13:
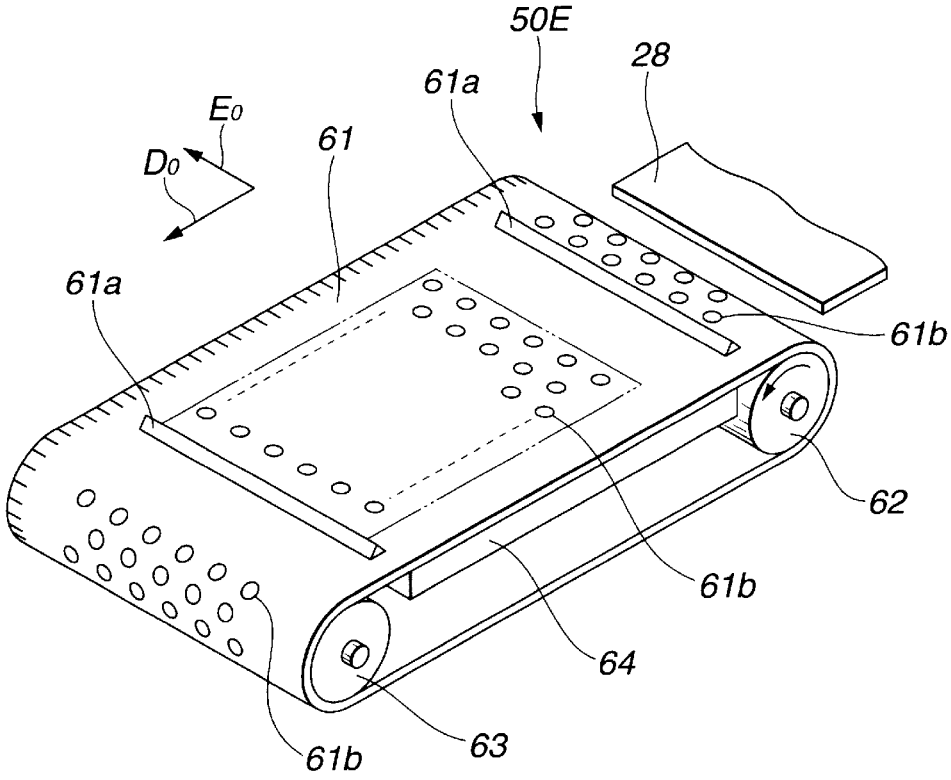
FIG. 13 is a perspective view showing another variant, which includes a paper sucker, of the paper transportation system employed in the printer in accordance with the first embodiment shown in FIG. 1.
Figure 14:
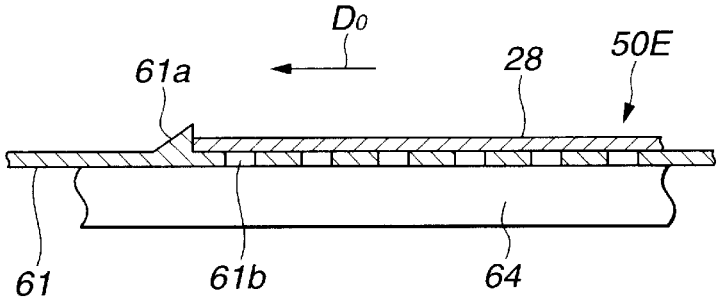
FIG. 14 is a longitudinal sectional view showing part of the paper transportation system of the variant that is shown in FIG. 13 and that holds paper.

FIG. 13 is a perspective view showing a paper transportation system 50E of another variant that includes a paper sucker. FIG. 14 is a longitudinal sectional view showing part of the paper transportation system 50E that holds paper. The paper transportation system 50E of the present variant comprises a transportation belt 61, a driving roller 63, a driven roller 62, and various sensors (not shown). The transportation belt 61 for transporting paper is an endless belt. The driving roller 63 drives the transportation belt.

A printer head is located above the transportation surface of the transportation belt 61. A sucker 64 is located inside the paper transportation surface of the transportation belt 61. The other components of a printer to which the paper transportation system 50E is adapted are identical to those of the printer 10 in accordance with the first embodiment.

The transportation belt 61 has a paper positioning projection 61*a*, which serves as a paper positioning means, formed at the distal edge of each paper area on the transportation surface in which the paper 28 is held. The paper positioning projection 61*a* is extended in the direction E0 (direction of the width of paper). Moreover, a group of intake holes 61 through which the sucker 64 sucks paper is formed within each paper area that expands behind the projection 61*a* in a direction opposite to the direction D0 (direction of paper transportation).

In a printer to which the paper transportation system 50E is adapted, when the projection 61*a* on the transportation belt 61 reaches the upstream edge in the direction D0, the paper 28 is thrust by a paper thrust roller (not shown). The distal edge of the paper 28 is abutted on the projection 61*a*, and the sucker 64 sucks the paper 28. The paper 28 is therefore transported in the direction D0 with the distal edge thereof abutted on the projection 61*a*. During transportation, a printer head prints the paper. These actions are performed under the control of the CPU 1.

According to the paper transportation system 50E of the present variant, the paper 28 can be held in a more accurate place.

Figure 15:
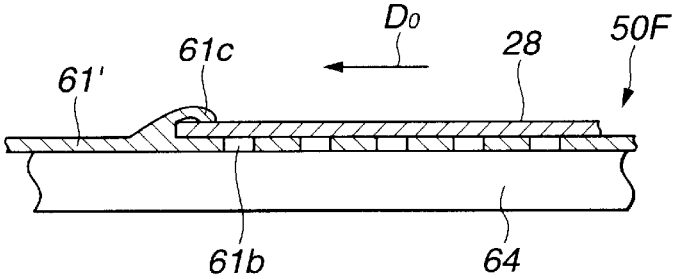
FIG. 15 is a longitudinal sectional view showing part of another variant, which includes a paper sucker, of the paper transportation system employed in the printer in accordance with the first embodiment shown in FIG. 1.

FIG. 15 is a longitudinal sectional view showing part of a paper transportation system 50F of still another variant, which includes a paper sucker, with paper held on the paper transportation system 50F. The paper transportation system 50F comprises a transportation belt 61', a driving roller and a driven roller (not shown), and various sensors that are not shown. The transportation belt 61' for transporting paper is an endless belt. The driving roller drives the transportation belt. The components other than the transportation belt 61' are identical to those of the paper transportation system 50E of the aforesaid variant.

A paper clamping claw 61*c* serving as a paper positioning means is extended in the direction E0 (direction of the width of paper) along the distal edge of each paper area on the transportation surface of the transportation belt 61' in which the paper 28 is held. Moreover, a group of intake holes 61*b* through which the sucker 64 sucks paper is formed within each paper area that expands behind the clamping claw 61*c* in the direction D0 (direction of paper transportation).

The paper clamping claw 61*c* has a claw-like shape and can elastically deform to clamp the distal edge of the paper 28. When the paper clamping claw 61*c* formed on the transportation belt 61' reaches the upstream edge of the transportation belt, the distal edge of the paper 28 is inserted into a recess of the paper clamping claw 61*c* and thus clamped by the paper clamping claw 61*c*. The paper 28 is sucked by the sucker 64 while being clamped, thus held on the transportation belt 61', and then transported in the direction D0 by the transportation belt 61'. These actions are performed under the control of the CPU 1.

According to the paper transportation system 50F of the present variant, the paper 28 can be held more reliably.

Figure 16:
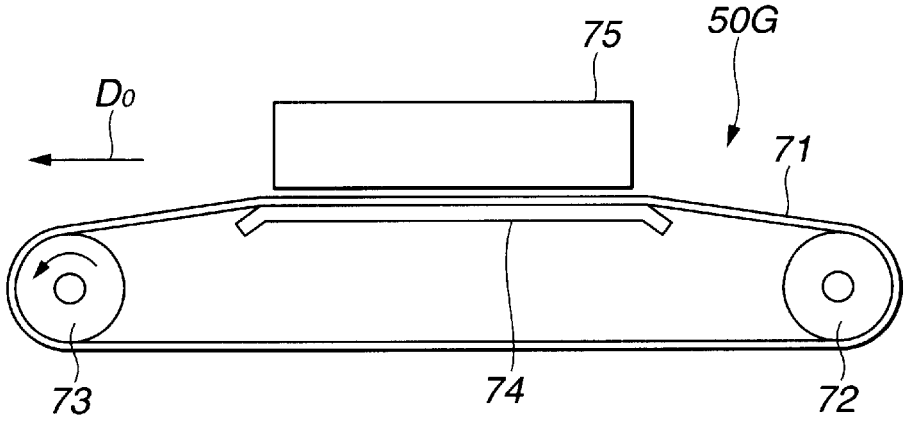
FIG. 16 is a side view showing another variant of the paper transportation system employed in the printer in accordance with the first embodiment shown in FIG. 1.

FIG. 16 is a side view of a paper transportation system 50G that is still another variant. The paper transportation system 50G of the present variant comprises a transportation belt 71, a driving roller 73, a driven roller 72, a flat-plate platen 74, and various sensors that are not shown. The transportation belt 71 for transporting paper is an endless belt. The driving roller 73 drives the transportation belt. The flat-plate platen 74 is placed inside the paper transportation surface of the transportation belt 71. A printer head 75 is located above the flat-plate platen 74 with the transportation belt 71 between them. The components of a printer, to which the paper transportation system 50G is adapted, other than the printer head 75 and paper transportation system 50G are identical to those of the printer 10 in accordance with the first embodiment.

The flat-plate platen 74 is located above a plane defined by the driving roller 73 and driven roller 72, whereby the transportation belt 72 is tensed while traveling on the platen 74.

According to the paper transportation system 50G of the present variant, the transportation belt 71 placed on the platen is highly tensed. This means that the flatness of the paper held on the transportation belt 71 can be maintained highly precisely. Moreover, pitching of the transportation belt 71 can be minimized. Consequently, a space between the transportation belt 71 and paper can be held constant all the time. Eventually, the time required for ink drops to reach the surface of paper after being jetted out can be held constant. Points on the paper at which the ink drops are shot are hardly deviated from right points. This results in successful printing.

Figure 17:
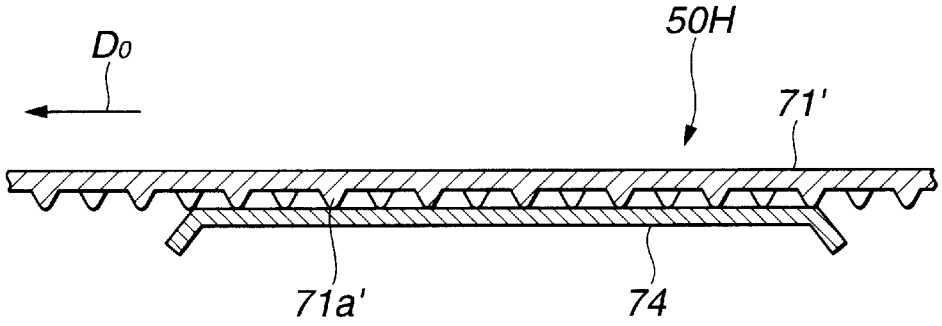
FIG. 17 is a longitudinal sectional view showing part of another variant of the paper transportation system employed in the printer in accordance with the first embodiment shown in FIG. 1.

FIG. 17 is a longitudinal sectional view showing part of a paper transportation system 50H that is still another variant. The paper transportation system 50H of the present variant comprises a transportation belt 71', a driving roller and a driven roller (not shown), a flat-plate platen 74, and various sensors (not shown). The transportation belt 71' for transporting paper is an endless belt. The driving roller drives the transportation belt. The flat-plate platen 74 is placed inside the paper transportation surface of the transportation belt 71'. The paper transportation system 50H is different from the paper transportation system 50G only in the sectional shape of the transportation belt 71'.

Dot-like projections 71*a* are scattered all over a portion of the inner surface of the transportation belt 71' that comes into contact with and slides on the flat-plate platen 74. The paper transportation system 50H of the present variant provides the same advantage as the paper transportation system 50G of the aforesaid variant. In addition, even when the transportation belt 71' on the platen is highly tensed, the sliding resistance (frictional resistance) of the transportation belt 71' will not increase. The transportation belt 71' can be driven while being little loaded.

Figure 18A:
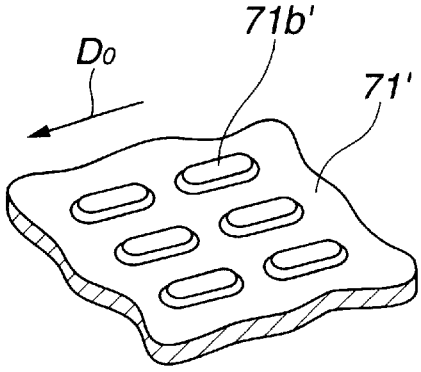
FIG. 18A is a perspective view showing the projections of a transportation belt included in another variant of the paper transportation system employed in the printer in accordance with the first embodiment shown in FIG. 1.
Figure 18B:
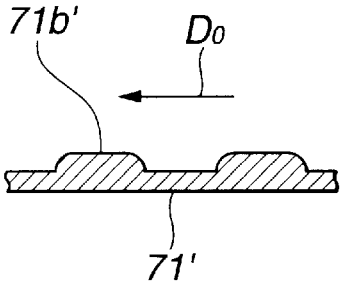
FIG. 18B is a longitudinal sectional view showing part of the projections of the transportation belt included in the paper transportation system of the variant shown in FIG. 18A.

FIG. 18A and FIG. 18B show different shapes adaptable to the projections formed on the transportation belt of the paper transportation system 50H of the above variant. FIG. 18A is a perspective view, and FIG. 18B is a longitudinal sectional view. Oblong projections 71*b*' that are oblong in the direction D0 are formed on the inner surface of the transportation belt 71' included in the variant which comes into contact with or slides on the flat-plate platen.

When the paper transportation system including the transportation belt 71' that has the differently shaped projections is adopted, similarly to when the paper transportation system 50H is adopted, the sliding resistance (frictional resistance) of the transportation belt 71' little increases. At the same time, the transportation belt is driven to transport paper in the direction D0 on a stable basis.

Figure 19:
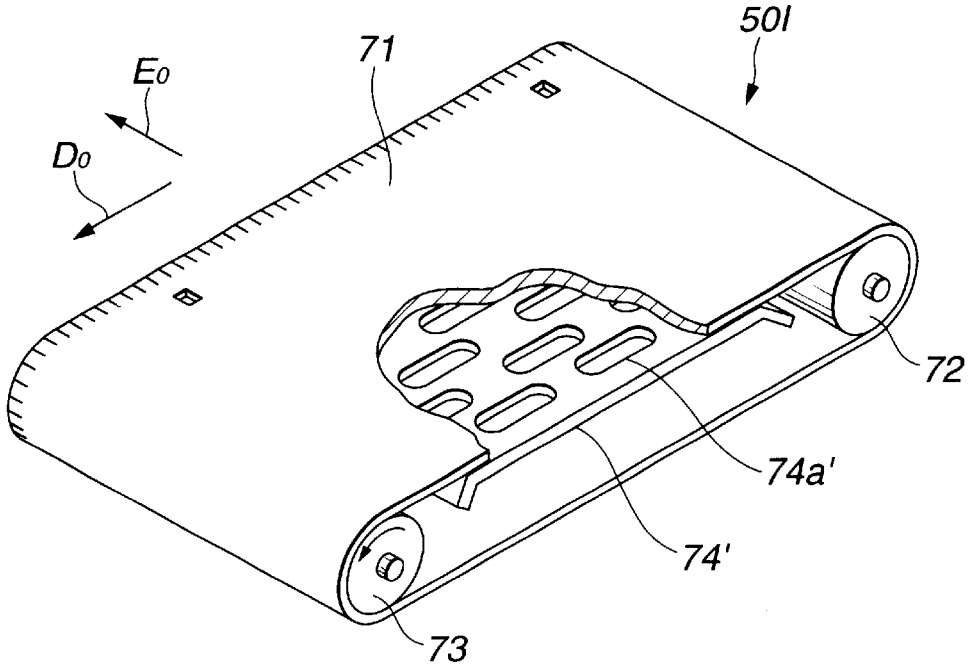
FIG. 19 is a perspective view showing another variant of the paper transportation system employed in the printer in accordance with the first embodiment shown in FIG. 1.

FIG. 19 is a perspective view of a paper transportation system 50I that is still another variant. The paper transportation system 50I of the present variant comprises a transportation belt 71, a driving roller 73 and a driven roller 72 (not shown), a flat-plate platen 74', and various sensors (not shown). The transportation belt 71 for transporting paper is an endless belt. The driving roller 73 drives the transportation belt. The flat-plate platen 74' is placed inside the paper transportation surface of the transportation belt 71. The paper transportation system 50I is different from the paper transportation system 50G only in the shape of the flat-plate platen 74'.

Oblong holes 74*a*' that are oblong in the direction D0 are scattered all over the surface of the flat-plate platen 74' that comes into contact with or slides on the inner surface of the transportation belt 71.

The paper transportation system 50I of the present variant provides the same advantage as the paper transportation system 50G of the aforesaid variant. In addition, even if the transportation belt 71 placed on the platen 74' is highly tensed, the sliding resistance (frictional resistance) of the transportation belt 71 will not increase due to the presence of the oblong holes 74*a*'. The transportation belt 71 can be driven while being less loaded.

Figure 20:
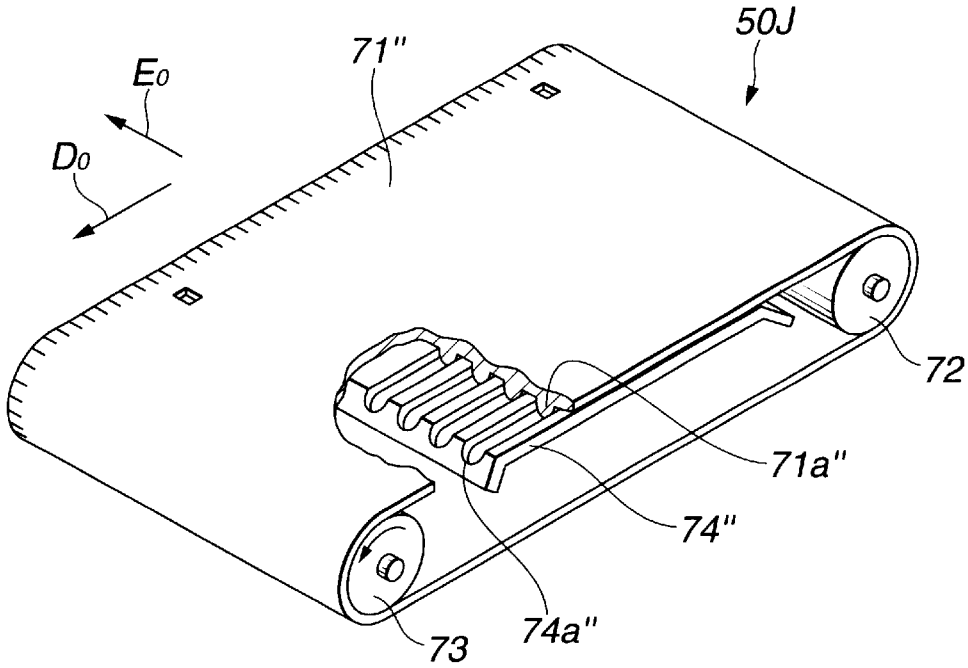
FIG. 20 is a perspective view showing another variant of the paper transportation system employed in the printer in accordance with the first embodiment shown in FIG. 1.
Figure 21:
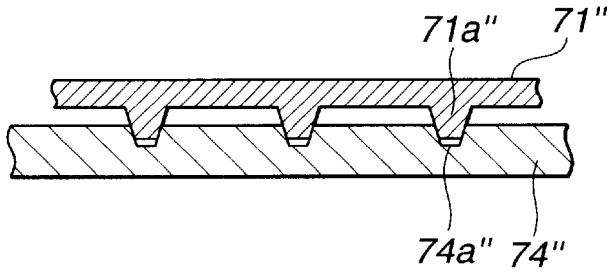
FIG. 21 is a sectional view showing part of a platen included in the paper transportation system of the variant shown in FIG. 20.

FIG. 20 is a perspective view of a paper transportation system 50J that is still another variant. FIG. 21 is a sectional view showing part of a platen included in the paper transportation system 50J of the variant. The paper transportation system 50J of the variant comprises a transportation belt 71", a driving roller 73, a driven roller 72, a flat-plate platen 74", and various sensors (not shown). The transportation belt 71" for transporting paper is an endless belt. The driving roller 73 drives the transportation belt. The flat-plate platen 74" is placed inside the paper transportation surface of the transportation belt 71". The paper transportation system 50J is different from the paper transportation system 50G in the sectional shape of the inner surface of the transportation belt 71" and in the sectional shape of the sliding surface of the flat-plate platen 74".

A plurality of projections 71*a*" is formed on the inner surface of the transportation belt 71" along nearly the entire width of the transportation belt 71". The projections 71*a*" are extended in the direction D0 and lined in rows in the direction E0. Moreover, a plurality of grooves 74*a*" is formed in the surface of the flat-plate platen 74" that comes into contact with or slide on the inner surface of the transportation belt 71". The grooves 74*a*" in which the projections 71*a*" are fitted so that they can slide freely are extended in the direction D0.

The paper transportation system 50J of the present variant provides the same advantage as the paper transportation system 50G of the aforesaid variant. In addition, since the transportation belt 71" travels over the platen 74" while being guided by the grooves 74*a*", the sliding resistance (frictional resistance) of the transportation belt 71" will not increase. Moreover, the transportation belt 71" will not vibrate in the direction E0, but is driven on a stable basis with a certain gap preserved between the transportation belt and a printer head.

Figure 22:
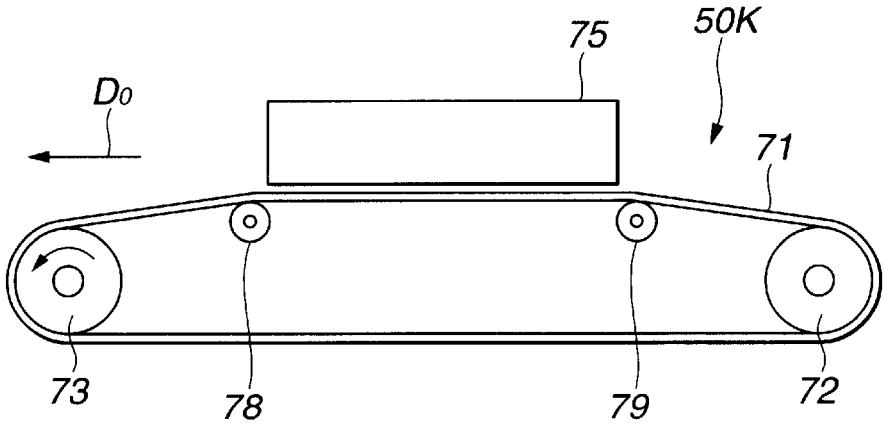
FIG. 22 is a side view showing another variant of the paper transportation system employed in the printer in accordance with the first embodiment shown in FIG. 1.

FIG. 22 is a side view of a paper transportation system 50K that is still another variant. The paper transportation system 50K of the present variant comprises a transportation belt 71, a driving roller 73, a driven roller 72, two driven platen rollers 78 and 79, and various sensors (not shown). The transportation belt 71 for transporting paper is an endless belt. The driving roller 73 drives the transportation belt. The driven platen rollers 78 and 79 capable of rotating are placed downstream and upstream inside the paper transportation surfaced of the transportation belt 71. A printer head 75 is placed above a range defined by the driven platen rollers 78 and 79. The components of a printer, to which the paper transportation system 50K is adapted, other than the printer head 75 and paper transportation system 50K are identical to those of the printer 10 in accordance with the first embodiment.

A plane linking the outer circumferences of the driven platen rollers 78 and 79 is located above a plane linking the outer circumferences of the driving roller 73 and driven roller 72, whereby the transportation belt 71 is tensed while traveling between the driven platen rollers 78 and 79.

The paper transportation system 50K of the present variant has improved the flatness of the transportation belt 71 opposed to the printer head 75 while the transportation belt 71 travels between the driven platen rollers 78 and 79. Moreover, pitching of the transportation belt 71 can be suppressed. Furthermore, by adjusting the vertical positions of the driven platen rollers 78 and 79, the gap between the printer head 75 and transportation belt 71 can be adjusted easily.

Figure 23A:
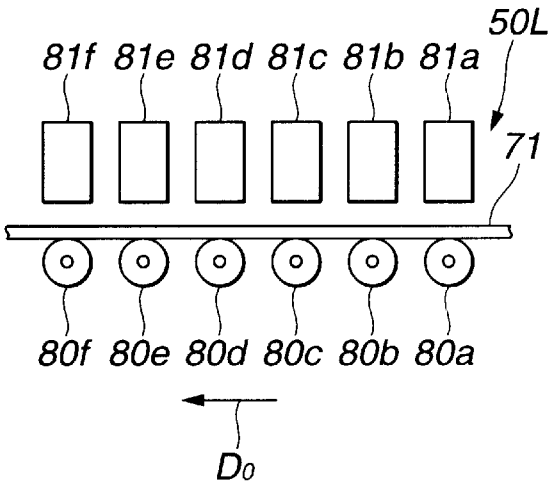
FIG. 23A is a longitudinal sectional view showing part of another variant of the paper transportation system employed in the printer in accordance with the first embodiment shown in FIG. 1.
Figure 23B:
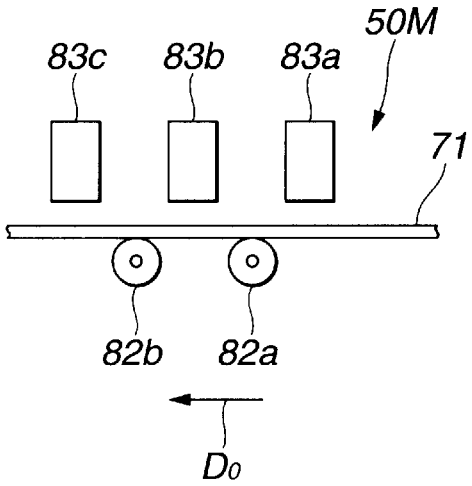
FIG. 23B is a longitudinal sectional view showing part of another variant of the paper transportation system employed in the printer in accordance with the first embodiment shown in FIG. 1.

FIG. 23A and FIG. 23B are longitudinal sectional views showing parts of printer heads included in paper transportation systems that are still another variants and their surroundings. FIG. 23A shows a paper transportation system 50L, and FIG. 23B shows a paper transportation system 50M.

The paper transportation systems 50L and 50M of the variants are different from the paper transportation system 50K of the aforesaid variable in a point that a plurality of driven platen rollers is placed in association with a plurality of head units that constitutes a printer head. The head units resemble the head units 35*a* and 35*b* shown in FIG. 4.

In the paper transportation system 50L of the variant, as shown in FIG. 23A, driven platen rollers 80*a*, 80*b*, 80*c*, 0*d*, 80*e*, and 80*f* are opposed to head units 81*a*, 81*b*, 81*c*, 81*d*, 81*e*, and 81*f* arranged in the direction D0 with the centers of the driven platen rollers aligned with the centers of the head units. At this time, the driven platen rollers 80*a*, 80*b*, 80*c*, 0*d*, 80*e*, and 80*f* can be rotated and abutted on the inner surface of the transportation belt 71.

On the other hand, the paper transportation system 50M of the variant has, as shown in FIG. 23B, driven platen rollers 82*a*, 82*b*, etc. placed among the head units 83*a*, 83*b*, 83*c*, etc. that are arranged in the direction D0. At this time, the driven platen rollers 82*a*, 82*b*, etc. are abutted on the inner surface of the transportation belt 71 and are each opposed to a middle point in a space between adjoining head units.

The paper transportation system 50L or 50M of the variant provides the same advantage as the paper transportation system 50G of the aforesaid variant. In addition, since the plurality of driven platen rollers is opposed to the head units, pitching of the transportation belt 71 is reliably suppressed. The gap between the head units and transportation belt 71 can be held constant.

Figure 24:
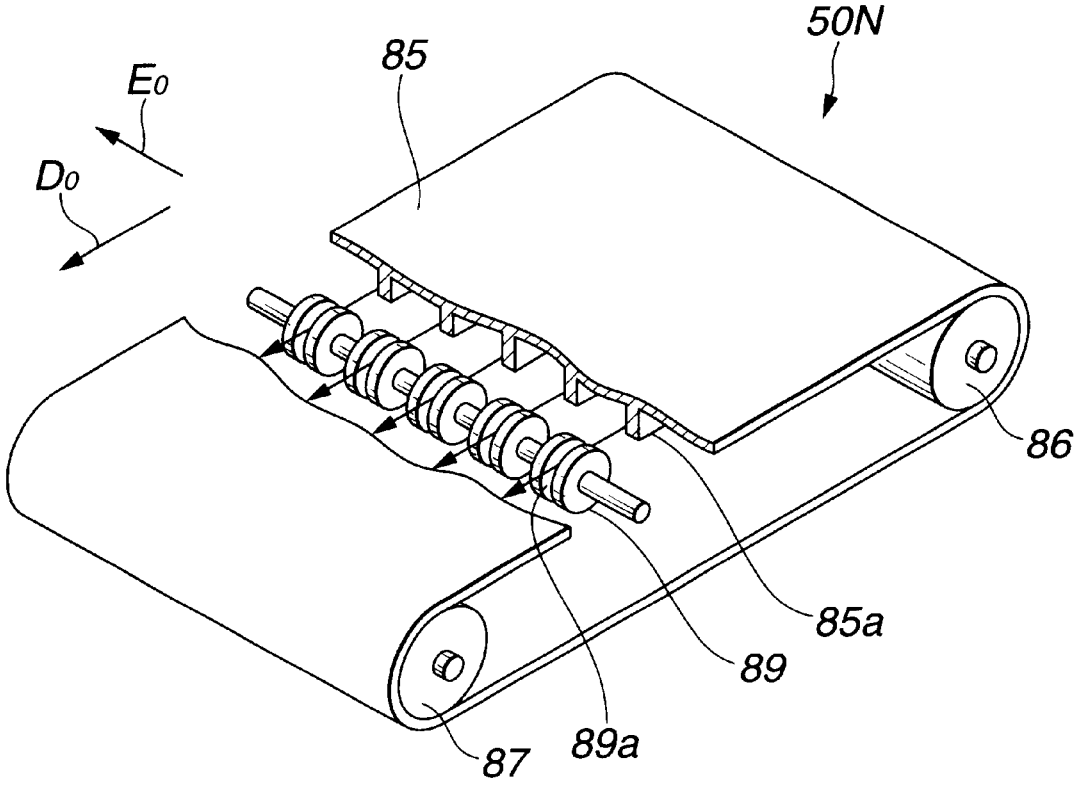
FIG. 24 is a perspective view showing another variant of the paper transportation system employed in the printer in accordance with the first embodiment shown in FIG. 1.

FIG. 24 is a perspective view of a paper transportation system 50N that is still another variant. The paper transportation system 50N of the present variant comprises a transportation belt 85, a driving roller 87, a driven roller 86, a plurality of driven platen rollers 89 (only one driven platen roller is shown in FIG. 24), and various sensors (not shown). The transportation belt 85 for transporting paper is an endless belt. The driving roller 87 drives the transportation belt. The plurality of driven platen rollers 89 that can rotate is placed inside the paper transportation surface of the transportation belt 85, extended in the direction E0, and juxtaposed in the direction D0. The other components are identical to those of the paper transportation system 50K of the aforesaid variant.

The transportation belt 85 has a plurality of parallel projections 85*a* formed on the inner surface thereof. The parallel projections 85*a* are extended linearly in the direction D0 and juxtaposed in the direction E0 with an equal pitch between adjoining projections. Moreover, each of the driven platen rollers 89 has a plurality of grooves 89*a* formed in the outer circumferences thereof. The plurality of parallel projections 85*a* is fitted in the grooves 89*a*. The two driven platen rollers 89 having the parallel projections 85*a* fitted in the grooves 89*a* thereof are located inside the transportation belt 85 at upstream and downstream positions opposed to the edges of a printer head. Otherwise, two or more rollers may be juxtaposed inside the transportation belt 85 within a range confined by the edges of the printer head.

The paper transportation system 50N of the present variant provides the same advantage as the paper transportation system 50K. In addition, the transportation belt 85 will not be displaced in the direction E0 of the width of paper. Printing can be achieved more successfully.

Figure 25:
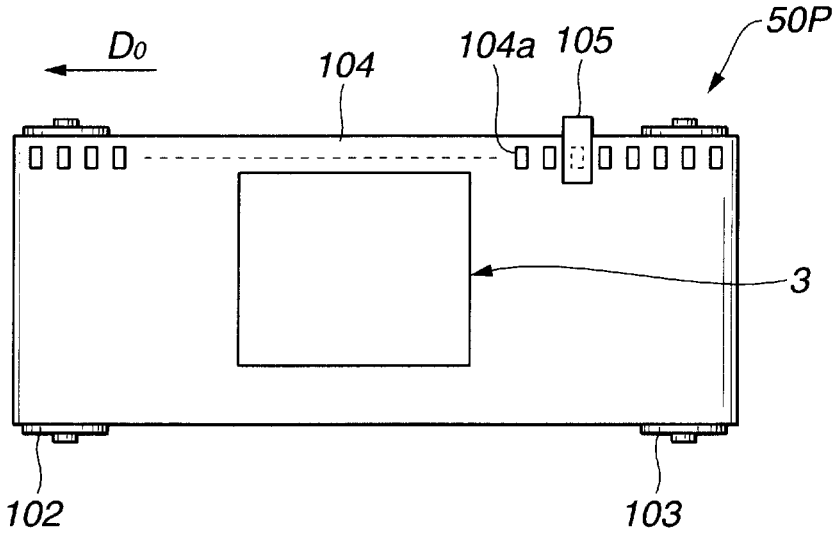
FIG. 25 is a plan view showing another variant of the paper transportation system employed in the printer in accordance with the first embodiment shown in FIG. 1.

FIG. 25 is a plan view showing a paper transportation system 50P that is still another variant. The paper transportation system 50P of the present variant comprises a transportation belt 104, a driving roller 102, a driven roller 103, and various sensors. The transportation belt 104 for transporting paper is an endless belt. The driving roller 102 drives the transportation belt. The sensors include a belt speed/position detection sensor 105 that is formed with a photo-interrupter, and a paper tip position sensor (not shown). A printer head 3 is placed above the transportation belt 104. The components of a printer, to which the paper transportation system 50P is adapted, other than the printer head 3 and paper transportation system 50P are identical to those of the printer 10 in accordance with the first embodiment.

The transportation belt 104 has mark holes 104*a* formed at predetermined intervals in the direction D0. The belt speed/position detection sensor 105 detects passage of the mark holes 104*a* so as to help detect the traveling speed of the transportation belt 104 and the position of the distal edge of paper. Control actions are performed to control the paper transportation system 50P under the control of the CPU 1.

According to the paper transportation system 50P of the present variant, the traveling speed of the transportation belt 104 and the position of the distal edge of paper can be detected highly precisely.

Figure 26:
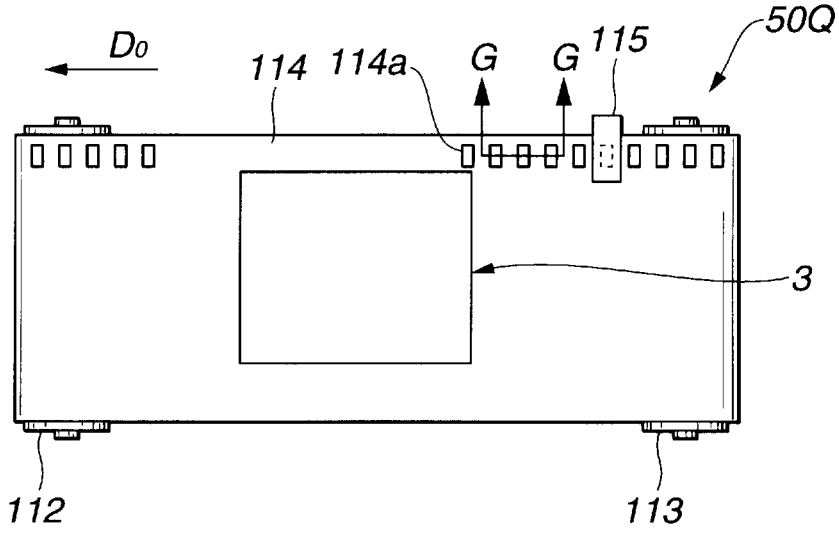
FIG. 26 is a plan view showing another variant of the paper transportation system employed in the printer in accordance with the first embodiment shown in FIG. 1.
Figure 27:
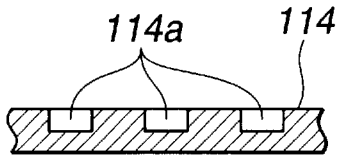
FIG. 27 is a G—G sectional view of the paper transportation system shown in FIG. 26.

FIG. 26 is a plan view showing a paper transportation system 50Q that is still another variant. FIG. 27 is a G—G sectional view of the paper transportation system 50Q shown in FIG. 26, showing a cross section of a transportation belt that is included in the paper transportation system 50Q and that has concave parts. The paper transportation system 50Q of the present variant comprises a transportation belt 114, a driving roller 112, a driven roller 113, and various sensors. The transportation belt 114 for transporting paper is an endless belt. The driving roller 112 drives the transportation belt. The various sensors include a belt speed/position detection sensor 115 that is formed with a photo-reflector, and a paper tip position sensor (not shown). A printer head 3 is placed above the transportation belt 114. The other components of a printer to which the paper transportation system 50Q is adapted are identical to those of the printer 10 in accordance with the first embodiment.

The transportation belt 114 has concave mark parts 114*a* formed in the direction D0 at predetermined intervals. The belt speed/position detection sensor 115 detects passage of the concave mark parts 114*a* so as to help detect the traveling speed of the transportation belt 114 and the position of the distal edge of paper. These control actions are performed to control the paper transportation system 50Q under the control of the CPU 1.

According to the paper transportation system 50Q of the present variant, the speed of the transportation belt 114 and the position of the distal edge of paper can be detected highly precisely.

The concave mark parts 114*a* formed at predetermined intervals may be replaced with black and white marks. Otherwise, the transportation belt may be magnetized at predetermined intervals. In this case, a magnetic sensor is adopted as the belt speed/position detection sensor.

Figure 28:
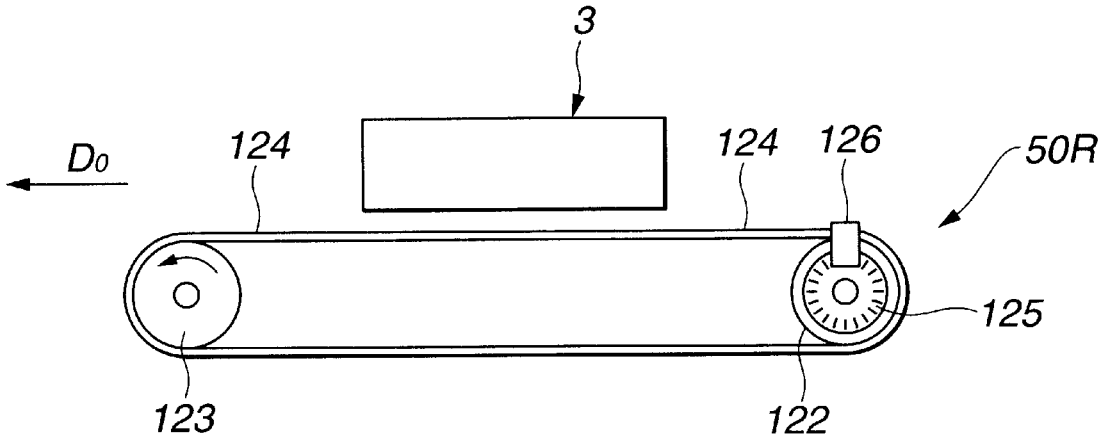
FIG. 28 is a side view showing another variant of the paper transportation system employed in the printer in accordance with the first embodiment shown in FIG. 1.

FIG. 28 is a side view showing a paper transportation system 50R that is still another variant. The paper transportation system 50R of the present variant comprises a transportation belt 124, a driving roller 123, a driven roller 122, and various sensors. The transportation belt 124 for transporting paper is an endless belt. The driving roller 123 drives the transportation belt. The various sensors include a speed/position detection sensor 126 that is formed with a photo-interrupter, and a paper tip position sensor (not shown). Furthermore, a printer head 3 is placed above the transportation belt 124. The other components of a printer to which the paper transportation system 50R is adapted are identical to those of the printer 10 in accordance with the first embodiment.

A slit plate 125 is fixed to the driven roller 122. The slit plate 125 has a slit formed at predetermined intervals along the outer edge thereof. The slits serve as marks used to detect the traveling speed of the transportation belt 124 and the position of the distal edge of paper. The speed/position detection sensor 126 detects the rotation of the slit plate 125 by sensing passage of the slits. The paper transportation system 50R is controlled under the control of the CPU 1.

According to the paper transportation system 50R of the present variant, the speed/position detection sensor 126 detects the rotation of the slit plate 125 so as to help detect the traveling speed of the transportation belt 124 and the position of the distal edge of paper. The traveling speed of the transportation belt 124 and the position of the distal edge of paper can therefore be detected highly precisely.

Figure 29:
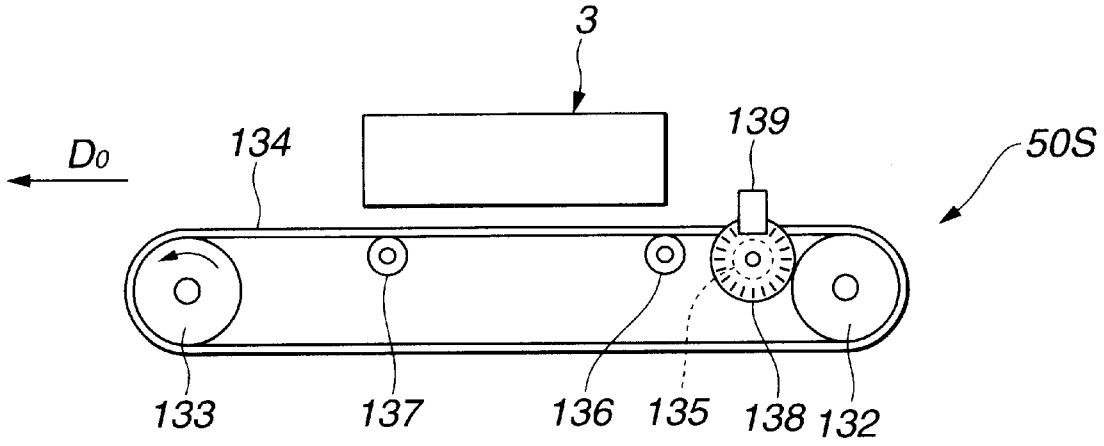
FIG. 29 is a side view showing another variant of the paper transportation system employed in the printer in accordance with the first embodiment shown in FIG. 1.

FIG. 29 is a side view showing a paper transportation system 50S that is still another variant. The paper transportation system 50S of the present variant comprises a transportation belt 134, a driving roller 133, a driven roller 132, driven platen rollers 135, 136, and 137, and various sensors. The transportation belt 134 for transporting paper is an endless belt. The driving roller 133 drives the transportation belt. The driven platen rollers 135, 136, and 137 are placed inside the paper transportation surface of the transportation belt 134. The various sensors include a speed/position detection sensor 139 that is formed with a photo-interrupter, and a paper tip position sensor (not shown). A printer head 3 is placed above the transportation belt 134. The other components of a printer to which the paper transportation system 50S is adapted are identical to those of the printer 10 in accordance with the first embodiment.

The driven platen rollers 136 and 137 are placed to be opposed to the edges of the whole of all the ink-jet surfaces included in the printer head 3. The driven platen roller 135 is placed by the upstream side of the driven platen roller 136. A slit plate 138 is fixed to the driven platen roller 135. The slit plate 138 has a slit formed at predetermined intervals along the outer edge thereof. The slits serve as marks used to detect the traveling speed of the transportation belt 134 and the position of the distal edge of paper. The speed/position detection sensor 139 senses passage of the slits to thus recognize rotation of the slit plate 138. The paper transportation system 50S is controlled under the control of the CPU 1.

According to the paper transportation system 50S of the present variant, the traveling speed of the transportation belt 134 and the position of the distal edge of paper can be detected based on an output of the speed/position detection sensor 139 that detects rotation of the slit plate 138 fixed to the driven platen roller 135. Therefore, the traveling speed of the transportation belt 134 and the position of the distal edge of paper can be detected highly precisely.

Figure 30:
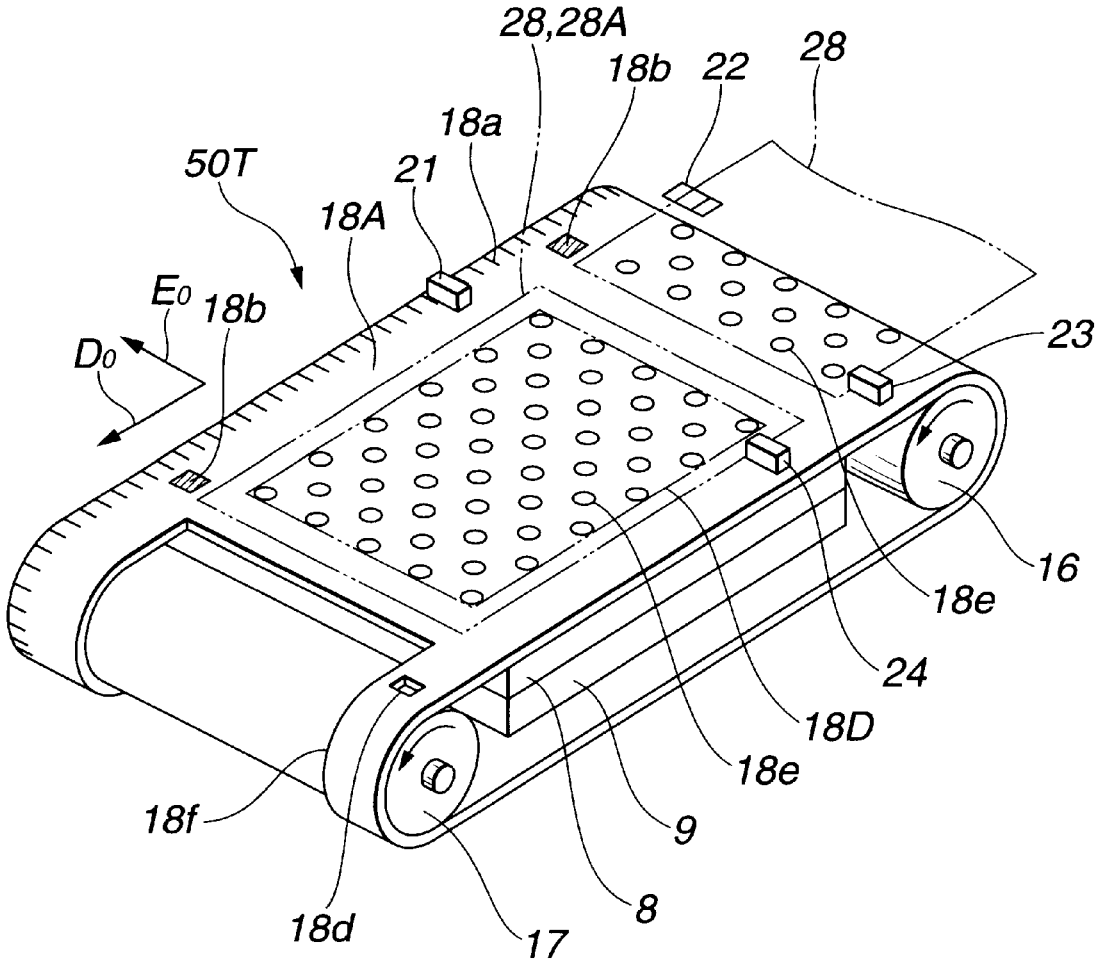
FIG. 30 is a perspective view showing another variant of the paper transportation system employed in the printer in accordance with the first embodiment shown in FIG. 1.

FIG. 30 is a perspective view showing a paper transportation system 50T that is still another variant. The paper transportation system 50T of the present variant has a recovery opening 18*f* formed in a transportation belt 18A instead of the recovery opening 18*c* formed in the transportation belt 18 employed in the first embodiment. The recovery opening 18*f* has a size corresponding to the area of the whole of all the ink-jet surfaces of the head units included in the printer head 3. The other components are identical to those of the paper transportation system 2 employed in the first embodiment.

When a printer to which the paper transportation system 50T of the present variant is adapted must be recovered, the sucker 8 is withdrawn and the transportation belt 18A is driven to travel. When it is detected that the recovery opening 18*f* formed in the transportation belt 18A has come to face the bottom of the printer head 3, the transportation belt 18A is stopped and the recovering device 9 is raised to face all the ink-jet surfaces included in the printer head 3. Ink is then jetted out from all the nozzles in order to clean the ink-jet surfaces. The jetted ink is introduced to the waste fluid tank 26 and reserved therein (see FIG. 2). The paper transportation system 50T is controlled under the control of the CPU 1.

According to the paper transportation system 50T of the present variant, all the ink-jet surfaces included in the printer head 3 can be cleaned simultaneously. Recovering can be completed shortly.

Next, a printer in accordance with a second embodiment of the present invention will be described in conjunction with FIG. 31.

Figure 31:
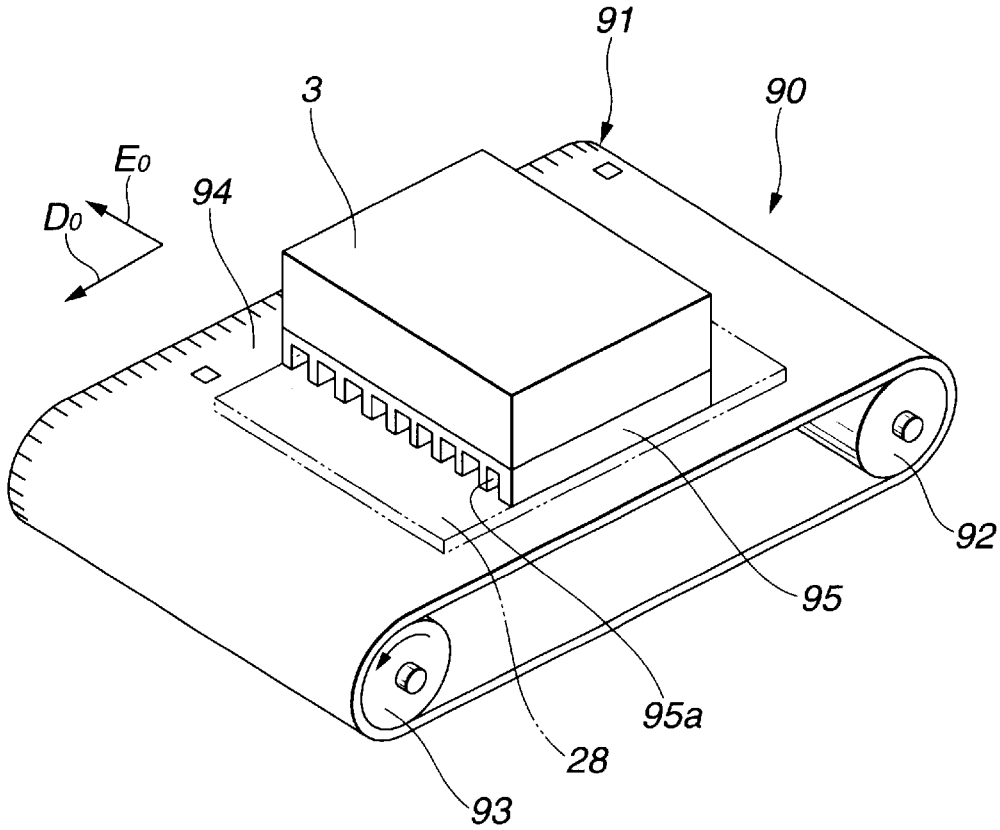
FIG. 31 is a perspective view showing a major portion of a printer in accordance with a second embodiment of the present invention.

FIG. 31 is a perspective view showing a major portion of a printer 90 in accordance with the second embodiment. The printer 90 in accordance with the second embodiment is an inkjet printer that jets out droplets of ink from a plurality of nozzles that covers the entire width of paper. The printer 90 comprises a paper transportation system 91, a printer head 3, a guard member 95, and a sucker (not shown). The paper transportation system 91 includes a transportation belt 94 that transports paper. The printer head 3 jets out ink drops. The guard member 95 serves as an air rectifying means. The sucker sucks paper to adsorb it to a predetermined place. The structure of the printer head 3 and the other components of the printer are identical to those of the printer 10 in accordance with the first embodiment.

The guard member 95 has rectification fins 95*a*, which rectify airflow, associated with the ink-jet surfaces of head units. The guard member 95 is placed in an ink-jet space created above the transportation belt 91 between the ink-jet surfaces included in the printer head 3 and paper.

According to the printer 90 of the present embodiment, airflow occurring between the ink-jet surfaces included in the printer head 3 and the paper 28 is rectified by the rectifying fins 95*a* and will not be disturbed. Therefore, jetted ink drops are shot in correct directions on a stable basis all the time. Printing is therefore performed highly precisely.

Next, a printer in accordance with a third embodiment of the present invention will be described in conjunction with FIG. 32 and FIG. 33.

Figure 32:
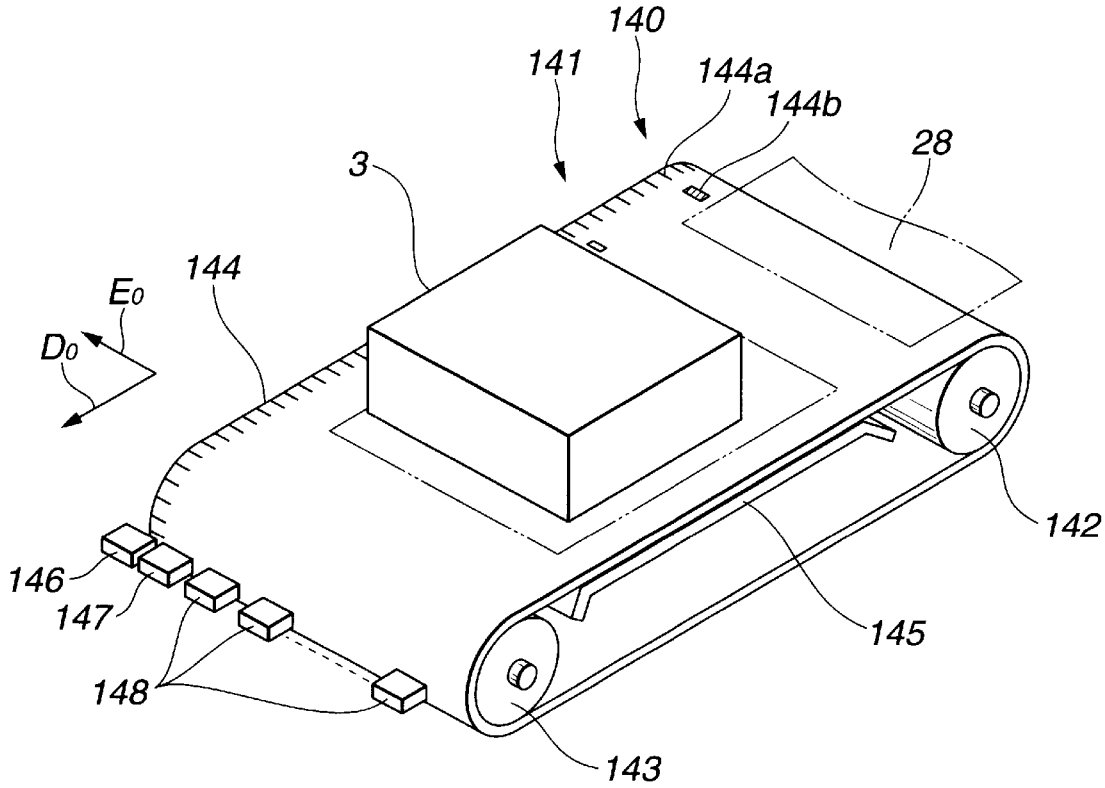
FIG. 32 is a perspective view showing a major portion of a printer in accordance with a third embodiment of the present invention.

FIG. 32 is a perspective view showing a major portion of a printer 140 in accordance with the third embodiment. FIG. 33 is a longitudinal sectional view showing a printer head included in the printer 140 and its surroundings.

The printer 140 in accordance with the present embodiment is an inkjet printer that jets out droplets of ink from a plurality of nozzles that covers the entire width of paper. The printer comprises a paper transportation system 141 that includes a transportation belt 144 for transporting paper, and a printer head 3 that jets out ink drops. The structure of the printer head 3 and the other components of the printer are identical to those of the printer 10 in accordance with the first embodiment.

The paper transportation system 141 comprises the transportation belt 144, a driving roller 143, a driven roller 142, a flat-plate platen 145, a speed/position detection sensor 146, a paper tip position sensor 147, and a group of distance sensors 148. The transportation belt 144 for transporting paper is an endless belt. The driving roller 143 drives the transportation belt. The flat-plate platen 145 is abutted on the inner surface of the transportation belt 144 that is opposite to the paper transportation surface thereof. The speed/position detection sensor 146 is formed with a photo-reflector. The paper tip position sensor 147 serves as a paper positioning means. The group of distance sensors 148 serves as an ink-jet distance detecting means that detects the thickness of the belt.

The transportation belt 144 has mark lines 144*a* and a paper tip position mark 144*b* inscribed thereon. The mark lines 144*a* are inscribed at predetermined intervals and used to detect the traveling speed of the transportation belt and the position of the distal edge of paper. The paper tip position mark 144*b* is used to inform the paper thrust roller 5 of the timing of thrusting paper.

The speed/position detection sensor 146, paper tip position sensor 147, and group of distance sensors 148 are arranged along the outer circumference of the driving roller 143 along the axis thereof. The speed/position detection sensor 146 detects passage of the mark lines 144*a* that are inscribed at predetermined intervals, whereby the traveling speed of the transportation belt 144 is detected. Moreover, the number of mark lines 144*a* that have passed the speed/position detection sensor 146 is counted in order to detect the position of the distal edge of paper. Moreover, the paper tip position sensor 147 detects passage of the paper tip position mark 144*b*. The paper thrust roller is actuated in response to a signal generated by the paper tip position sensor 147.

The distance sensors 148 are used to measure a distance to the surface of the transportation belt 144 so as to help detect the thickness of the transportation belt. The distance sensors 148 are arranged with a predetermined pitch between adjoining sensors in the direction of the width of an ink-jet area of the printer head 3. A distance to the surface of the transportation belt 144 is measured at different points in the direction D0 by the distance sensors 148 arranged in the direction E0 with the predetermined pitch between adjoining ones. At this time, the different points start with points (origins) at which the distance sensors 148 first measure the distance to the surface of the transportation belt 144 responsively to detection of passage of the paper tip position mark 144*b* by the paper pit position sensor 147. Thus, the thickness t of the transportation belt is detected at the points.

Figure 33:
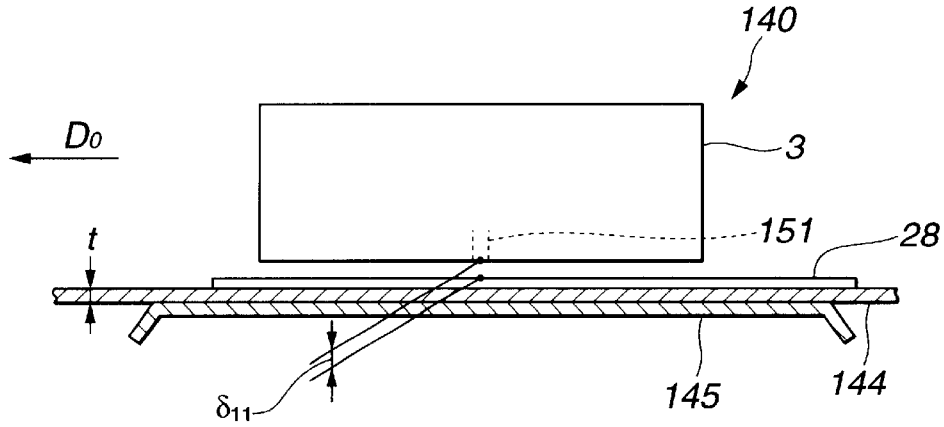
FIG. 33 is a longitudinal sectional view showing a printer head and its surroundings included in the printer in accordance with the third embodiment.

In the printer 140 of the present embodiment having the foregoing components, as shown in FIG. 33, the CPU 1 (see FIG. 1) calculates an ink-jet distance δ11 using the values of the belt thickness t measured at the points. The ink-jet distance δ11 is a distance between the surface of the paper 28 placed on the transportation belt 144, and each ink-jet surface included in the printer head 3. Based on the calculated values of the ink-jet distance δ11, a printing control means included in the CPU 1 instructs the head controller 15 (see FIG. 1) to control the timing of jetting out ink so that ink drops will be shot at correct points on the paper 28 being transported. Therefore, even if the ink-jet distance varies due to a difference in the thickness of the transportation belt 144, a deviation of any printed point on paper is corrected. Ink drops are shot at correct points on paper. These printing control actions are performed under the control of the CPU 1.

According to the printer 140 of the third embodiment, a deviation of any printed point on paper due to a difference in the thickness of the transportation belt 144 is prevented, and printing is performed successfully. As for the thickness t of the transportation belt 144, values of the thickness measured at points all over the belt may be stored in a memory. This obviates the necessity of measuring the thickness during transportation of paper, and leads to a simple control sequence.

Next, a description will be made of a printer which is a variant of the printer 140 in accordance with the third embodiment and in which a speed/position sensor and an origin sensor are employed in place of the speed/position sensor and paper tip position (origin) sensor.

Figure 34:
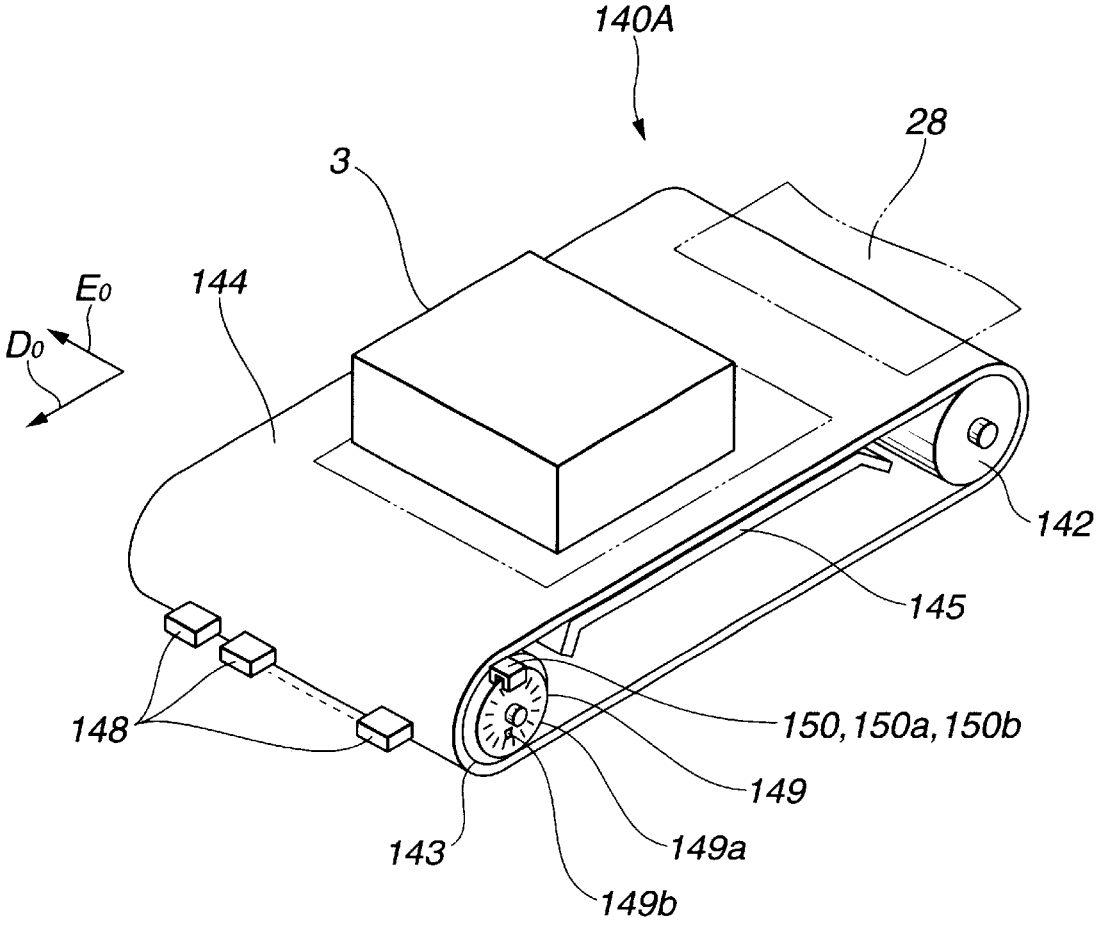
FIG. 34 is a perspective view showing a printer in accordance with a variant of the third embodiment of which speed/position and origin sensors are different from those of the printer in accordance with the third embodiment.

FIG. 34 is a perspective view showing a printer 140A of a variant in which speed/position and origin sensors 150 are incorporated. The printer 140A has the same components as the printer 140 in accordance with the third embodiment except the speed/position and origin sensors 150.

A slit plate 149 is fixed to a driving roller 143 for driving a transportation belt 144. First slits 149*a* are formed at predetermined intervals along the outer edge of the slit plate 149. The first slits 149*a* serve as speed/position marks used to detect the traveling speed of the transportation belt 144 and the position of the distal edge of paper. A second slit 149*b* serving as an origin/paper tip position mark used to indicate an origin or the distal edge of paper on the transportation belt 144 is also formed in the slit plate 149. A group of distance sensors 148 is formed as a ink-jet distance detecting means that detects a belt thickness is included similarly to the one employed in the third embodiment.

The speed/position and origin sensors 150 are sensors formed with two photo-interrupters. The speed/position sensor 150*a* detects passage of the first slits 149*a* so as to help detect the traveling speed of the transportation belt 144 and the position of the distal edge of paper. The origin sensor 150*b* that serves as a paper positioning means recognizes passage of the second slit 149*b* and thus senses that the distal edge of paper on the transportation belt 144 has reached the paper thrust roller. The paper thrust roller 5 (not shown) is then actuated in order to thrust paper. At the same time, points on the transportation belt that come to the distance sensors 148 when passage of the second slit 149*b* is detected are specified as reference points (origins) at which measuring the thickness t is started. The group of distance sensors 148 then starts measuring the thickness t of the transportation belt 144.

The group of distance sensors 148 is a plurality of sensors that is arranged with a predetermined pitch between adjoining sensors in the direction E0 (direction of the width of the transportation belt) within an ink-jet area of the printer head 3 in the same manner as those employed in the third embodiment. Points on the transportation belt 144 that come to the distance sensors 148 when the origin sensor 150*b* detects passage of the second slit 149*b* are specified as reference points (origins). A distance to the surface of the transportation belt is measured at different points in the direction of transportation by the distance sensors arranged in the direction of the width of the transportation belt 144. Thus, the values of the belt thickness t are measured and fetched into a memory.

Even in the printer 140A of the present variant having the foregoing components, the traveling speed of the transportation belt 144 and the position of the distal edge of paper are detected using the speed/position sensor 150*a*. Thrust of paper and jetting of ink drops are controlled based on the detected data. Similarly to the printer 140, a distance to the surface of the belt is measured at points that start with origins that are indicated by the origin sensor 150*b*. The ink-jet distance δ11 between the surface of the paper 28 and the printer head 3 is detected based on the values of the distance measured at the points specified in the direction D0 by the distance sensors arranged in the direction E0. The printing control means installed in the CPU 1 instructs the head controller 15 (see FIG. 1) to control the timing of jetting out ink from the printer head 3 according to the calculated values of the ink-jet distance δ11. Consequently, even if the ink-jet distance varies depending on the thickness of the transportation belt 144, a deviation of a printed point on paper is corrected. Ink drops are shot at correct points on paper all the time.

According to the printer 140A of the variant in which the speed/position and origin sensors 150 are incorporated, similarly to the printer 140, a deviation of a printed point on paper derived from a difference in the thickness of the transportation belt 144 is prevented. Moreover, the speed/position and origin sensors 150 occupy only a limited space. This results in the compact printer.

Next, a printer in accordance with a fourth embodiment of the present invention will be described below.

Figure 35:
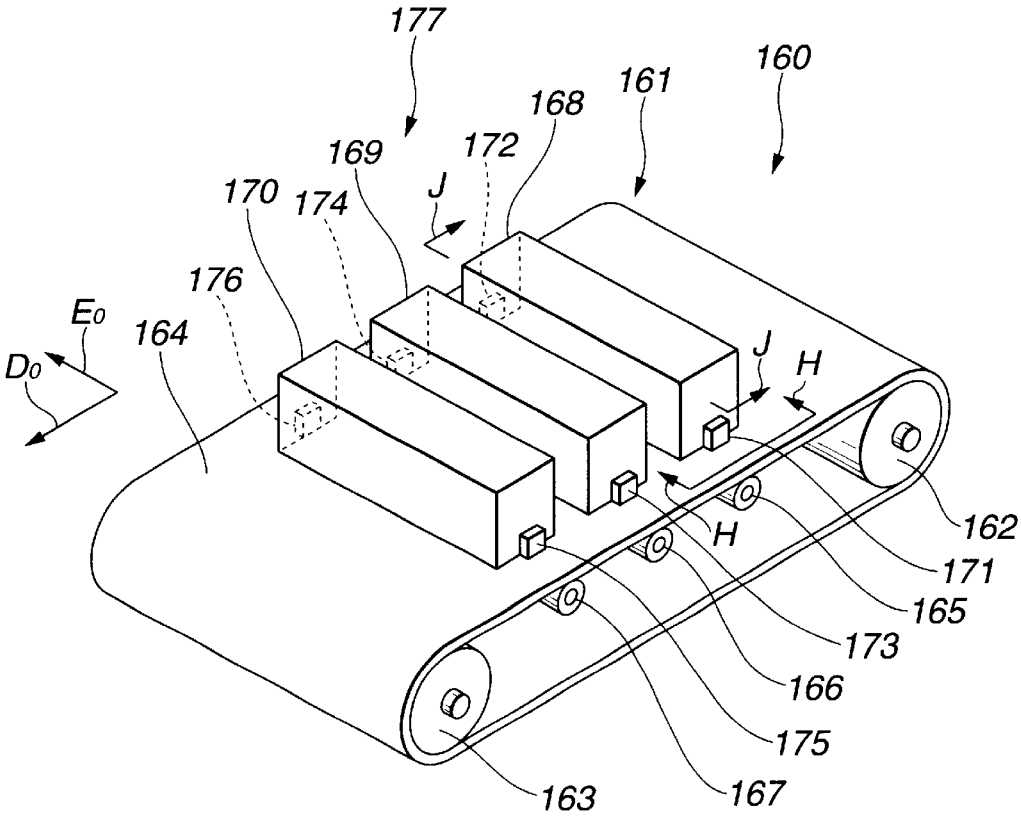
FIG. 35 is a perspective view showing a major portion of a printer in accordance with a fourth embodiment of the present invention.
Figure 36:
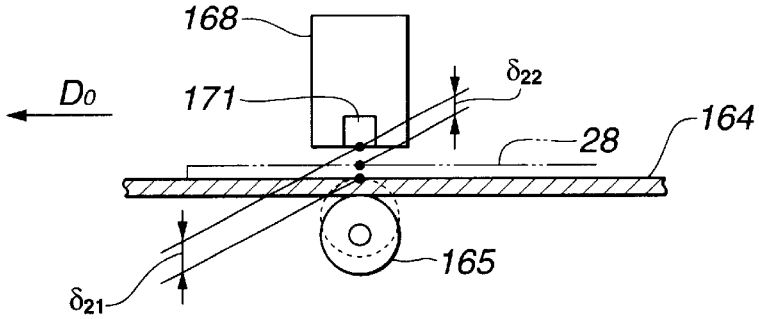
FIG. 36 is an H—H sectional view of the major portion shown in FIG. 35.
Figure 37:
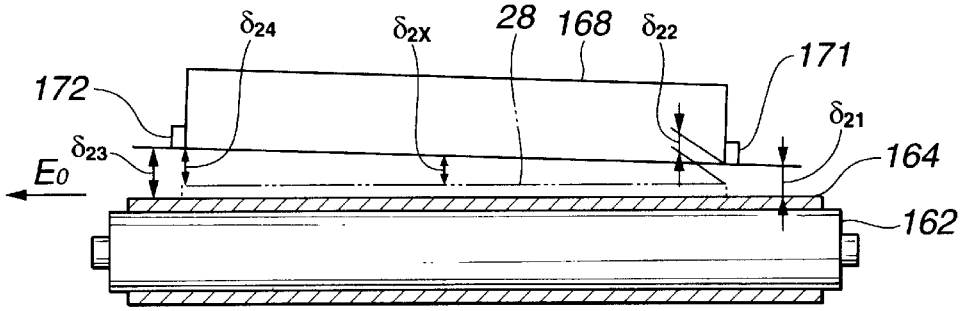
FIG. 37 is a J—J sectional view of the major portion shown in FIG. 35.

FIG. 35 is a perspective view showing a major portion of a printer 160 in accordance with the present embodiment. FIG. 36 is an H—H sectional view of the major portion shown in FIG. 35, showing a section of the printer 160 that extends in the direction D0 and includes the sections of a printer head and its surroundings. FIG. 37 is a J—J sectional view of the major portion shown in FIG. 35, showing a section of the printer that extends in the direction E0 and includes the sections of the printer head and its surroundings.

The printer 160 in accordance with the present embodiment is an inkjet printer for jetting out droplets of ink from a plurality of nozzles that covers the entire width of paper. The printer comprises a paper transportation system 161 and a printer head 177. The paper transportation system 161 includes a transportation belt 164 for transporting paper, and driven platen rollers 165, 166, and 167. The printer head 177 comprises three single-color head blocks. The other components are identical to those of the printer 10 in accordance with the first embodiment.

The paper transportation system 161 comprises the transportation belt 164, a driving roller 163, a driven roller 162, three driven platen rollers 165, 166, and 167, and a speed/position detection sensor (not shown). The transportation belt 164 for transporting paper is an endless belt. The driving roller 163 drives the transportation belt. The three driven platen rollers 165, 166, and 167 are placed inside the paper transportation surface of the transportation belt 164.

The printer head 177 has structures that resemble the head blocks described in conjunction with FIG. 8, or in other words, comprises the single-color head blocks 168, 169, and 170 that cover the entire width of paper. Distance sensors 171 and 172, 173 and 174, and 175 and 176 each pair of which serves as an ink-jet distance detecting means for measuring a distance from the surface of the transportation belt 164 are fixed to the ends in the direction E0 (direction of the width of paper) of the head blocks 168, 169, and 170 respectively.

The driven platen rollers 165, 166, and 167 are located in contact with the transportation belt 164 while opposed to the head blocks 168, 169, and 170.

The distance sensors 171 and 172 fixed to the ends of the head block 168 obtain distance values δ21 and δ23. The distance values δ21 and δ23 are values of a distance between an ink-jet surface and the surface of the transportation belt 164 which are measured at the ends of the head block 168 in the width direction of paper. The CPU 1 (see FIG. 1) calculates an ink-jet distance value δ22 that is a value of a distance between the right-end ink-jet surface and the surface of paper using the distance δ21. Likewise, the CPU 1 calculates an ink-jet distance value δ24 that is a value of a distance between the left-end ink-jet surface and the surface of paper using the distance δ23. Consequently, the ink-jet distance between an ink-jet surface and the surface of paper may vary, as shown in FIG. 37, depending on the precision in mounting a head block, depending on whether there is a change in the thickness of the transportation belt, or depending on whether any platen roller is eccentric.

The printing control means installed in the CPU 1 uses the ink-jet distance values δ22 and δ24 to calculate an ink-jet distance value δ2X that is a value of an ink-jet distance at each point on a straight line extended in the direction E0 (direction of the width of paper). The straight line is extended in the center of the head block 168. The timing of jetting out ink is determined based on the speed, at which the paper 28 is transported, according to the ink-jet distance value δ2X. The head block 168 is controlled so that ink drops will be jetted out according to the timing. Therefore, the ink drops are shot at undeviating points on paper. The same applies to the other head blocks 169 and 170. Namely, the distance sensors 173 and 174 or the distance sensors 175 and 176 are used to detect a variation of an ink-jet distance occurring in the direction E0. The timing of jetting out ink drops is controlled based on the variation.

According to the printer 160 of the fourth embodiment, as shown in FIG. 37, the distance sensors are fixed to both the ends of each head block in order to measure a distance to the transportation belt 164. Consequently, a variation of an ink-jet distance δ2X in the direction E0 is detected. Therefore, even if the distance from a head block to the surface of paper varies depending on a point in the direction E0, the head controller 15 (see FIG. 1) controls the timing of jetting out ink from each nozzle included in each head block. Consequently, ink drops are shot at correct points on paper all the time. A deviation of any printed point on paper dot will not occur.

Next, a printer in accordance with a fifth embodiment of the present embodiment will be described below.

Figure 38:
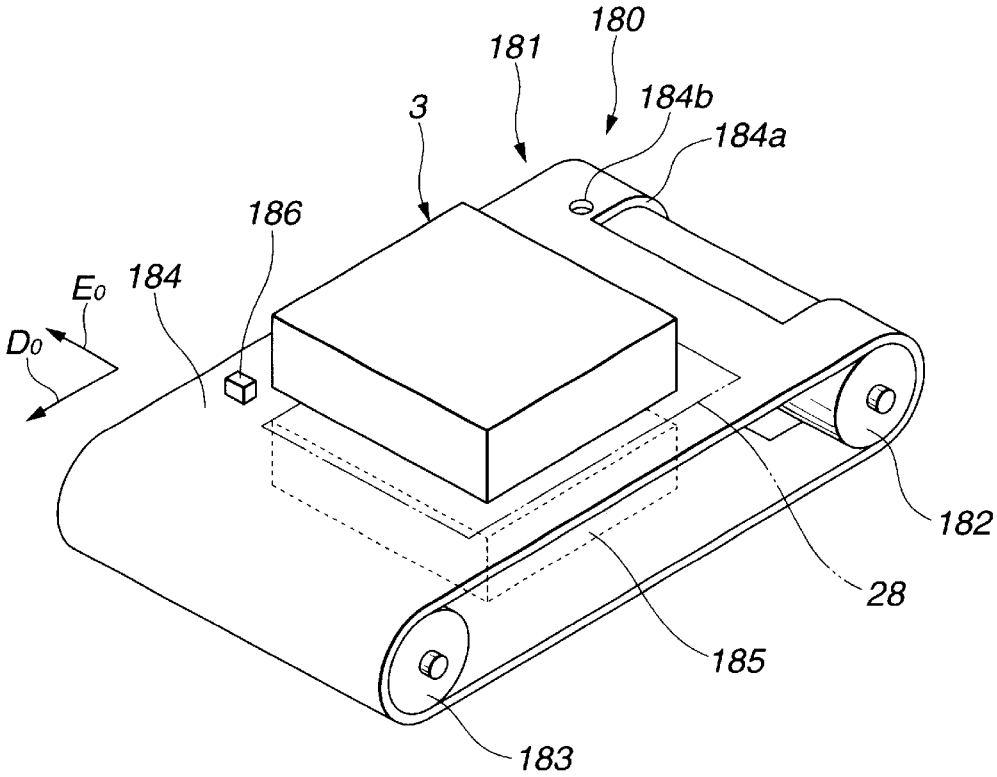
FIG. 38 is a perspective view showing the structure of a major portion of a printer in accordance with a fifth embodiment of the present invention.

FIG. 38 is a perspective view showing a major portion of a printer 180 of the present embodiment.

The printer 180 of the present embodiment is an inkjet printer that jets out droplets of ink from a plurality of nozzles that covers the entire width of paper. A recovering means for recovering the ability of a printer head to jet out ink is incorporated in the printer.

The printer 180 comprises a paper transportation system 181, a printer head 3, and a recovering device 185. The paper transportation system 181 includes a transportation belt 184 that transports paper. The recovering device 185 is a recovering means of a jetting/absorbing type that recovers the printer head 3. The structure of the printer head 3 and the other components are identical to those of the printer 10 in accordance with the first embodiment.

The paper transportation system 181 includes the transportation belt 184, a driving roller 183, a driven roller 182, an opening position sensor 186, and a speed/position detection sensor (not shown). The transportation belt 184 for transporting paper is an endless belt. The driving roller 183 drives the transportation belt. The opening position sensor 186 is used to detect a recovery area (an opening through which recovering is performed).

The transportation belt 184 has a recovery opening 184*a* and an opening detection hole 184*b*. The recovery opening 184*a* serves as a recovery area whose size corresponds to the size of an ink-jet area covering all the ink-jet surfaces included in the printer head 3. The opening detection hole 184*b* is used to detect the position of the recovery opening 184*a*. The paper 28 is not held in the recovery opening 184*a*.

The recovering device 185 receives and absorbs ink jetted out from the printer head 3 so as to recover the ability of the ink-jet surfaces included in the printer head 3 to jet out ink.

In the printer 180 of the present embodiment having the foregoing components, when the ink-jet surfaces included in the printer head 3 must be recovered, the transportation belt is driven. When the opening position sensor 186 detects presence of the opening detection hole 184*b*, the recovery opening 184*a* has reached underneath the printer head 3, or in other words, the recovery opening 184*a* is opposed to the bottom of the printer head 3. At this time, the transportation belt 184 is stopped. The recovering device 185 is inserted into the opening 184*a* and brought into close contact with the ink-jet surfaces included in the printer head 3.

With the recovering device 185 brought in close contact with the printer head, ink is jetted out from the printer head 3 for the purpose of recovery. This is intended to restore clogged nozzles. The recovering device absorbs jetted ink. After absorption is completed, the recovering device 185 is lowered in order to enable driving of the transportation belt. Owing to the above series of actions, the ability of the printer head 3 to jet out ink is recovered. The recovering actions are performed under the control of the CPU 1.

According to the printer 180 of the fifth embodiment, the recovery opening 184*a* is formed in the transportation belt 184. The recovering device is inserted into the recovery opening, whereby recovering the printer head 3 is enabled.

The opening detection hole 184*a* and opening position sensor 186 that are formed in the transportation belt 184 included in the printer 180 of the fifth embodiment may be replaced with a rotary encoder that is attached to the driving roller 183. In this case, whether the opening 184*a* is opposed to the printer head 3 is detected based on the number of pulses that the encoder produces depending on an angular movement from an origin.

Next, a printer in accordance with a sixth embodiment of the present invention will be described below.

Figure 39:
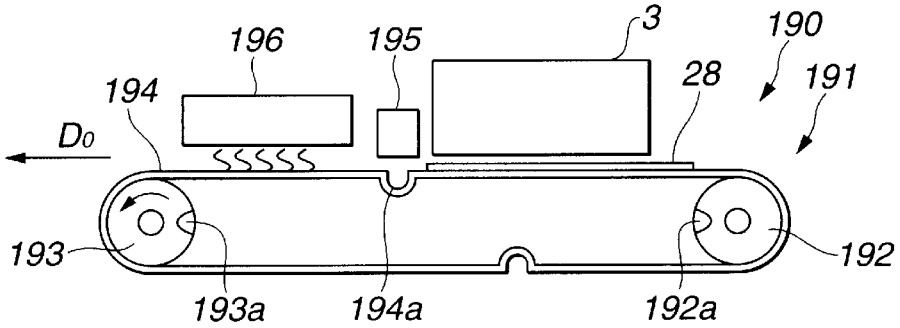
FIG. 39 is a side view showing the structure of a major portion of a printer in accordance with a sixth embodiment of the present invention.

FIG. 39 is a side view showing a major portion of a printer 190 in accordance with the present invention.

The printer 190 in accordance with the present invention is an inkjet printer for jetting out droplets of ink from a plurality of nozzles that covers the entire width of paper for the purpose of printing. A drying means for drying printed paper and a recovering means for recovering the ability of a printer head to jet out ink are incorporated in the printer.

The printer 190 comprises a paper transportation system 191, a printer head 3, a belt cleaner 195, and a drier 196. The paper transportation system 191 includes a transportation belt 194 that transports paper. The belt cleaner 195 is a cleaning means (dirty belt recovering means). The drier 196 is a drying means that utilizes heated air. The structure of the printer head and the other components are identical to those of the printer 10 in accordance with the first embodiment.

The paper transportation system 191 comprises the transportation belt 194, a driving roller 193, a driven roller 192, and a speed/position detection sensor (not shown). The transportation belt 194 for transporting paper is an endless belt. The driving roller 193 drives the transportation belt.

The driving roller 193 and driven roller 192 have concave parts 193*a* and 192*a* respectively in which projections of ink reservoirs of the transportation belt 194 are fitted.

The transportation belt 194 has the groove-like ink reservoirs 194*a* in which ink jetted out from the printer head 3 for the purpose of recovery is reserved.

The belt cleaner 195 is located above the upper route of the transportation belt 194 by the downstream side of the printer head 3. The belt cleaner 195 absorbs ink reserved in the ink reservoir 194*a* formed in the transportation belt 194.

The drier 196 is located above the upper route of the transportation belt 194 by the downstream side of the belt cleaner 195. The drier 196 feeds heated air to the transportation belt 194, thus drying printed paper.

In the printer 190 of the present embodiment having the foregoing components, the paper 28 printed by the printer head 3 passes below the drier 196 in the direction D0, and has thus its printed surface dried up. The paper 28 is then stowed in a discharge tray (not shown).

Moreover, when the ink-jet surfaces included in the printer head 3 must be recovered, the transportation belt 194 is driven in the direction D0 so that the ink reservoir 194*a* will pass below the printer head 3. During the passage, ink is jetted out from a head unit out of the head units 35*a*, 35*b*, etc. (see FIG. 4) constituting the printer head 3 which is opposed to the ink reservoir 194*a*. The ability of the ink-jet surface of each head unit is thus recovered. When the ink reservoir 194*a* passes the entire ink-jet area of the printer head 3, recovering is completed. Jetted ink is reserved in the ink reservoir 194*a*, absorbed by the ink cleaner 195, and then discharged to outside. These recovering actions are performed under the control of the CPU 1.

According to the printer 190 of the sixth embodiment, the belt cleaner 195 located above the transportation belt 194 is used to recover the printer head 3. A recovering means need not be placed inside the transportation belt 194. This leads to a simple structure. Moreover, the drier 196 dries printed paper.

Next, a printer in accordance with a seventh embodiment of the present invention will be described below.

Figure 40:
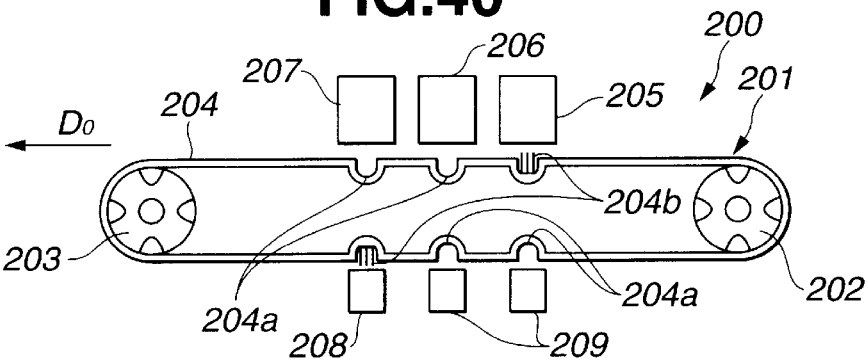
FIG. 40 is a side view showing the structure of a major portion of a printer in accordance with a seventh embodiment of the present invention.

FIG. 40 is a side view showing a major portion of a printer 200 in accordance with the present embodiment.

The printer 200 in accordance with the present embodiment is an inkjet printer for jetting out droplets of ink from a plurality of nozzles that covers the entire width of paper. A wiping means for recovering the ability of a printer head to jet out ink and a cleaner for cleaning the wiping means are incorporated in the printer.

The printer 200 comprises a paper transportation system 201, a printer head, a wiper cleaner 208, and a belt cleaner 209. The paper transportation system 201 includes a transportation belt that transports paper and a head wiping means (recovering means). The printer head comprises a plurality of single-color head blocks 205, 206, and 207. The wiper cleaner 208 is a cleaning means for cleaning a head wiping means. The belt cleaner 209 serves as a dirty belt recovering means. The single-color head blocks have the same structure as the single-color head block 48 that is associated with a single color and that is shown in FIG. 8. The other components are identical to those of the printer 10 in accordance with the first embodiment.

The paper transportation system 201 includes the transportation belt 204, a driving roller 203, a driven roller 202, and a speed/position detection sensor (not shown). The transportation belt 204 for transporting paper is an endless belt. The driving roller 203 drives the transportation belt.

The transportation belt 204 has a plurality of groove-like ink reservoirs 204*a* and ink-jet surface wipers 204*b*. The ink reservoirs 204*a* are included in a recovering means that instructs head blocks 205, 206, and 207 to jet out ink for the purpose of recovery. Jetted ink is reserved in the ink reservoirs 204*a*. The ink-jet surface wipers 204*b* have a wiping member embedded therein and serve as a head wiping means for wiping the ink-jet surfaces included in the printer head along with traveling of the transportation belt.

The ink reservoirs 204*a* are grooves each pair of which is located by the downstream side (in the direction D0) of each ink-jet surface wiper 204*b*. When the transportation belt travels, the ink reservoirs 204*a* pass below the ink-jet surfaces included in the head blocks 205, 206, and 207 respectively, and receive ink jetted from the head blocks during recovering.

An ink absorber (for example, a sponge) is placed in the concave parts of the ink reservoirs 204*a*. During recovering, jetted ink is absorbed with the ink absorbers. The concave parts of the ink reservoirs 194*a* shown in FIG. 39 may have the same structure as the ink reservoirs 204*a*.

The wiper cleaner 208 is located below the return route of the transportation belt 204 (that travels in a direction opposite to the direction D0). When each of the ink-jet surface wipers 204*b* having blades comes to the wiper cleaner 208 together with the transportation belt, the wiper cleaner 208 cleans the wiper to restore it.

The belt cleaners 209 are located downstream in the return route of the transportation belt 204 (that travels in a direction opposite to the direction D0). The belt cleaners 209 absorb and collect ink reserved in the ink reservoirs 204*a* of the transportation belt 204.

In the printer 200 of the present embodiment having the foregoing components, when printing is started, recovering is performed. Specifically, when the ink reservoirs 204*a* of the transportation belt 204 reach below the bottoms of the head blocks 205, 206, and 207 respectively, ink is jetted out from the head blocks in order to resolve clogging of the ink-jet surfaces included in the head blocks. The jetted ink is reserved in the ink reservoirs 204*a*. The ink in the ink reservoirs 204*a* is absorbed by the belt cleaners 209 along the return route of the transportation belt 204. Thereafter, the head blocks print paper. During the printing, when the ink-jet surface wiper 204*b* passes the ink-jet surfaces included in each head block, the ink-jet surfaces are wiped off. Thus, the ink-jet surfaces included in the head blocks are wiped off all the time. Moreover, the ink-jet surface wiper 204*b* is cleaned by the wiper cleaner 208 along the return route of the transportation belt, and thus restored. These recovering actions are performed under the control of the CPU 1.

According to the printer 200 of the seventh embodiment, the ink-jet surface wiper 204*b* cleans the ink-jet surfaces included in the head blocks 205, 206, and 207 all the time. Printing is therefore performed in good condition. Moreover, when ink is jet out from the head blocks during recovering that is performed in an initial stage of printing, the ink is reserved in the ink reservoirs 204*a* in the transportation belt 204, and then absorbed by the belt cleaners 209. This means that the transportation belt is also cleaned easily and reliably.

Next, a printer in accordance with an eighth embodiment of the present invention will be described below.

Figure 41:
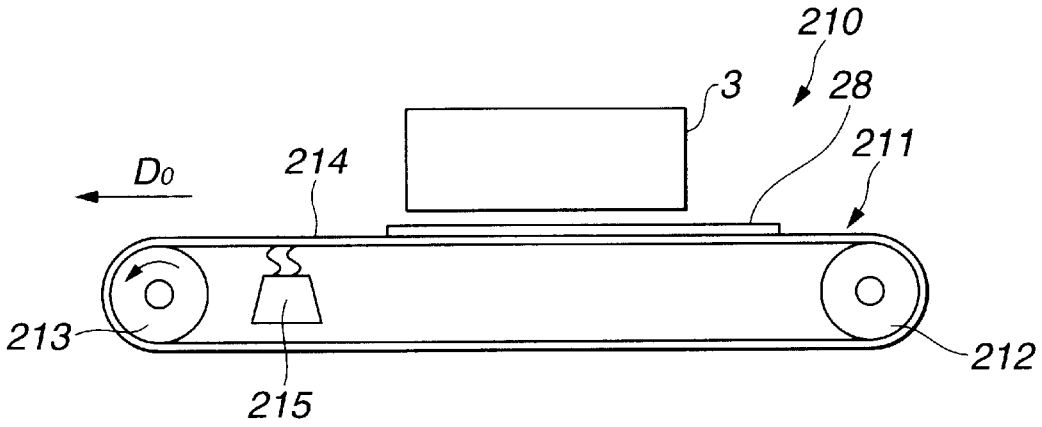
FIG. 41 is a side view showing the structure of a major portion of a printer in accordance with an eighth embodiment of the present invention.

FIG. 41 is a side view showing a major portion of a printer 210 of the present embodiment.

The printer 210 of the present embodiment is an inkjet printer for jetting out droplets of ink from a plurality of nozzles that covers the entire width of paper. A drying means for drying printed paper is incorporated in the printer 210.

The printer 210 comprises a paper transportation system 211, a printer head 3, and a drier 215. The paper transportation system 211 includes a transportation belt 214 that transports paper. The printer head 3 has the same structure as the printer head adapted to the printer 10 of the first embodiment. The drier 215 is a drying means that utilizes heated air. The other components are identical to those of the printer 10 in accordance with the first embodiment.

The paper transportation system 211 includes the transportation belt 214, a driving roller 213, a driven roller 212, and a speed/position detection sensor (not shown). The transportation belt 214 for transporting paper is an endless belt. The driving roller 213 drives the transportation belt.

The drier 215 is located by the downstream side of printer head 3 and placed below the inner surface of the transportation belt 214. The drier 215 feeds heated air to the inner surface of the transportation belt 214, whereby printed paper is dried.

In the printer 210 of the present embodiment having the foregoing components, the printed paper 28 that has passed the printer head 3 moves in the direction D0 above the drier 215 together with the transportation belt 214. The paper has the printed surface thereof dried up and is then stowed in the discharge tray (not shown). These actions are performed under the control of the CPU 1.

According to the printer 210 of the eighth embodiment, the paper 28 is dried up by the drier 215, which is located inside the transportation belt 214, after being printed. A drier need not be placed above the transportation belt 214. This results in a printer that offers improved user-friendliness and that is designed compactly.

Next, a printer in accordance with a ninth embodiment of the present invention will be described below.

Figure 42:
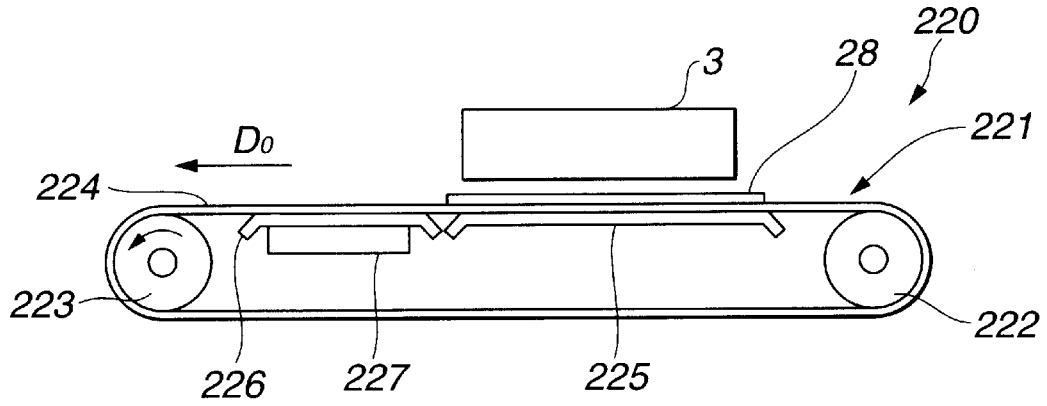
FIG. 42 is a side view showing the structure of a major portion of a printer in accordance with a ninth embodiment of the present invention.

FIG. 42 is a side view showing a major portion of a printer 220 in accordance with the present embodiment.

The printer 220 in accordance with the present embodiment is an inkjet printer for jetting out droplets of ink from a plurality of nozzles that covers the entire width of paper. A drying means for drying printed paper is incorporated in the printer 220.

The printer 220 comprises a paper transportation system 221, a printer head 3, and a drier 227. The paper transportation system 221 includes a transportation belt 224 that transports paper. The drier 227 is a drying means that utilizes electric heating. The structure of the printer head 3 and the other components are identical to those of the printer 10 in accordance with the first embodiment.

The paper transportation system 221 includes the transportation belt 224, a driving roller 223, a driven roller 222, a flat-plate platen 225, and a speed/position detection sensor (not shown). The transportation belt 224 for transporting paper is an endless belt. The driving roller 223 drives the transportation belt. The flat-plate platen 225 is abutted on the inner surface of the transportation belt 224 opposite to the paper transportation surface thereof.

The drier 227 is formed with an electric heater that is mounted on the flat-plate platen 226. The flat-plate platen 226 is located by the downstream side of the printer head 3 and abutted on the inner surface of the transportation belt 224. The drier 227 dries up printed paper with the flat-plate platen 226 between them.

In the printer 220 of the present embodiment having the foregoing components, the printed paper 28 that has passed the printer head 3 moves above the drier 227 in the direction D0 together with the transportation belt 224. Meanwhile, the paper 28 has the printed surface thereof dried up, and is then stowed in the discharge tray (not shown). These actions are performed under the control of the CPU 1.

According to the printer 220 of the ninth embodiment, the drier 227 that is placed inside the transportation belt 224 dries up the paper 28 that has been printed. A drier need not be placed above the transportation belt 224. This leads to improved user-friendliness of the printer. Moreover, the drier 227 is mounted on the flat-plate platen 226, and the flat-plate platen 226 is abutted directly on the transportation belt 224. This leads to improved heat conduction and suppressed power consumption.

Next, a printer in accordance with a tenth embodiment of the present invention will be described below.

Figure 43:
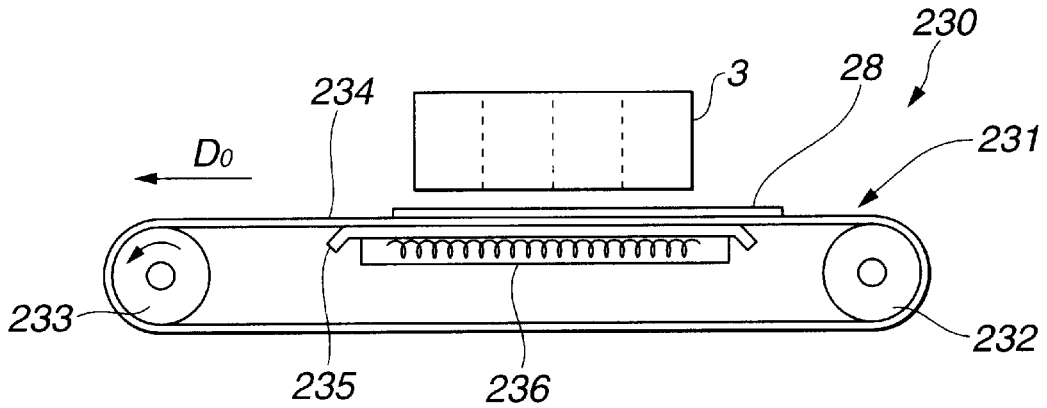
FIG. 43 is a side view showing the structure of a major portion of a printer in accordance with a tenth embodiment of the present invention.

FIG. 43 is a side view showing a major portion of a printer 230 in accordance with the present embodiment.

The printer 230 in accordance with the present embodiment is an inkjet printer for jetting out droplets of ink from a plurality of nozzles that covers the entire width of paper. A drying means for drying up printed paper is incorporated in the printer 230.

The printer 230 comprises a paper transportation system 231, a printer head 3, and a drier 236. The paper transportation system 231 includes a transportation belt 234 that transports paper. The drier 236 is a drying means that utilizes electric heating. The structure of the printer head and the components other than these components are identical to those of the printer 10 in accordance with the first embodiment.

The paper transportation system 231 includes the transportation belt 234, a driving roller 233, a driven roller 232, a flat-plate platen 235, and a speed/position detection sensor (not shown). The transportation belt 234 for transporting paper is an endless belt. The driving roller 233 drives the transportation belt. The flat-plate platen 235 is located below a printer head 3 and abutted on the inner surface of the transportation belt 232 opposite to the paper transportation surface thereof.

The drier 236 is formed with an electric heater mounted on the flat-plate platen 235 that is abutted on the inner surface of the transportation belt 214.

In the printer 230 of the present embodiment having the foregoing components, paper being printed is dried up below the printer head 3 with the flat-plate platen 235 and transportation belt 234 between the paper and the drier. These actions are performed under the control of the CPU 1.

According to the printer 230 of the tenth embodiment, the drier 236 is mounted on the flat-plate platen 235 placed inside the transportation belt 234. This results in the compact printer.

Next, a printer in accordance with an eleventh embodiment of the present invention will be described below.

Figure 44:
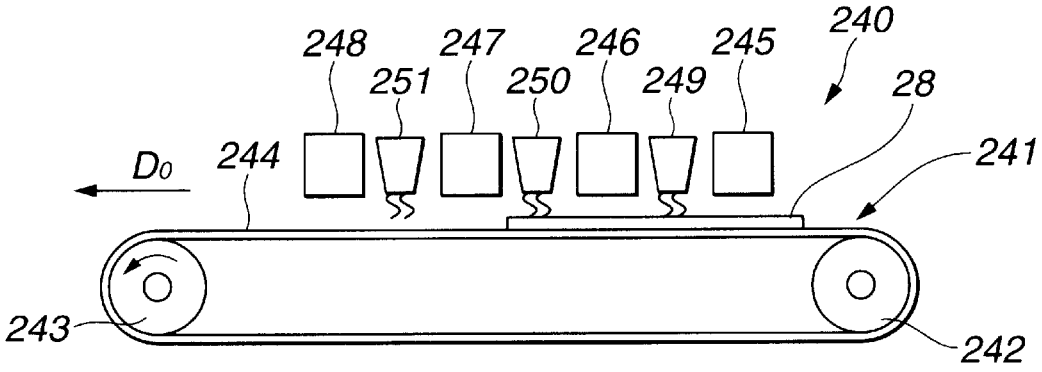
FIG. 44 is a side view showing the structure of a major portion of a printer in accordance with an eleventh embodiment of the present invention.

FIG. 44 is a side view showing a major portion of a printer 240 in accordance with the present embodiment.

The printer 240 in accordance with the present embodiment is an inkjet printer for jetting out droplets of ink from a plurality of nozzles that covers the entire width of paper. A drying means that dries up printed paper is incorporated in the printer 240.

The printer 240 includes a paper transportation system 241, a plurality of head blocks 245, 246, 247, and 248, and a plurality of drying units 249, 250, and 251 that serve as a drying means. The paper transportation system 241 includes a transportation belt 244 that transports paper. The head blocks have the same structure as the single-head block 48 that is associated with a single color and that is shown in FIG. 8. The other components are identical to those of the printer 10 in accordance with the first embodiment.

The paper transportation system 241 includes the transportation belt 244, a driving roller 243, a driven roller 242, and a speed/position detection sensor. The transportation belt 244 for transporting paper is an endless belt. The driving roller 243 drives the transportation belt.

The head blocks 245, 246, 247, and 248 are arranged above the transportation belt 244 at predetermined intervals in that order from the upstream edge of the transportation belt.

The drying units 249, 250, and 251 are air heating type driers that are independent of one another. The drying units 249, 250, and 251 are arranged alternately with the head blocks 245, 246, 247, and 248.

In the printer 240 of the present embodiment having the foregoing components, immediately after the head blocks 245, 246, and 247 print paper in associated colors, the drying units 249, 250, and 251 sequentially dry up the paper. These actions are performed under the control of the CPU 1.

According to the printer 240 of the eleventh embodiment, spread of printed colors is suppressed. Consequently, printing is achieved successfully.

Next, a printer in accordance with a twelfth embodiment of the present invention will be described below.

Figure 45:
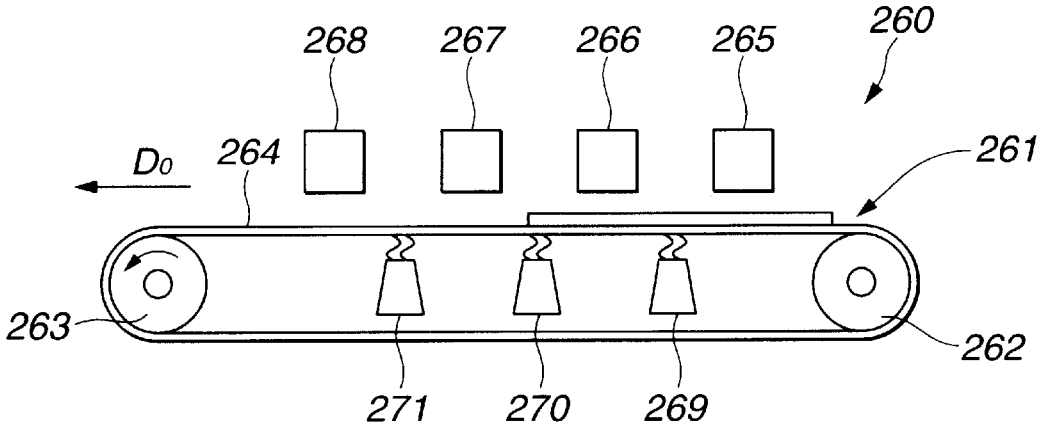
FIG. 45 is a side view showing the structure of a major portion of a printer in accordance with a twelfth embodiment of the present invention.

FIG. 45 is a side view showing a major portion of a printer in accordance with the present embodiment.

The printer 260 in accordance with the present embodiment is an inkjet printer for jetting out droplets of ink from a plurality of nozzles that covers the entire width of paper. A drying means that dries up printed paper is incorporated in the printer 260.

The printer 260 comprises a paper transportation system 261, a printer head, and a plurality of drying units 269, 270, and 271. The paper transportation system 261 includes a transportation belt 264 that transports paper. The printer head consists of a plurality of head blocks 265, 266, 267, and 268. The drying units 269, 270, and 271 serve as a drying means. The head blocks have the same structure as the single-color head block 48 that is associated with a single color and that is shown in FIG. 8. The other components are identical to those of the printer in accordance with the first embodiment.

The paper transportation system 261 includes the transportation belt 264, a driving roller 263, a driven roller 262, and a speed/position detection sensor (not shown). The transportation belt 264 for transporting paper is an endless belt. The driving roller 263 drives the transportation belt.

The head blocks 265, 266, 267, and 268 are arranged above the transportation belt 264 at predetermined intervals in that order from the upstream edge of the transportation belt.

The drying units 269, 270, and 271 are air heating type driers that are independent of one another. The drying units 269, 270, and 271 are each opposed to a middle point in a space between adjoing ones of the head blocks 265, 266, 267, and 268 while being placed inside the transportation belt 264.

In the printer 260 of the present embodiment having the foregoing components, after each of the head blocks 265, 266, 267, and 268 prints paper in associated color, the drying units 269, 270, and 271 dries up the printed paper from inside the belt. These actions are performed under the control of the CPU 1.

According to the printer 260 of the twelfth embodiment, spread of printed colors is suppressed. Consequently, printing is achieved successfully. Moreover, since the drying units are placed inside the transportation belt 264, the compact printer can be obtained.

Next, a printer in accordance with a thirteenth embodiment of the present invention will be described below.

Figure 46:
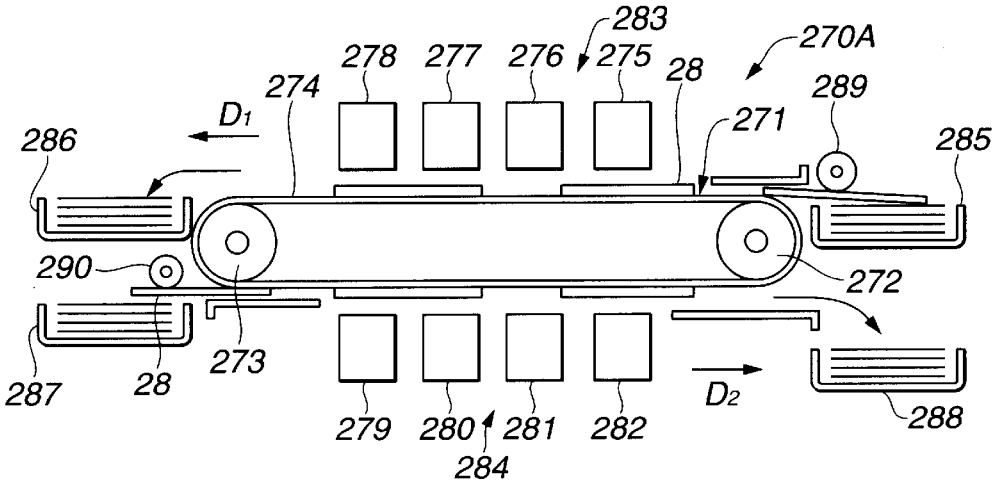
FIG. 46 is a side view showing the structure of a major portion of a printer in accordance with a thirteenth embodiment of the present invention.

FIG. 46 is a side view showing a major portion of a printer 270A in accordance with the present embodiment.

The printer 270A in accordance with the present embodiment is an inkjet printer for jetting out droplets of ink from a plurality of nozzles that covers the entire width of paper. Sheets of paper being transported in opposite directions along the advance and return routes of a transportation belt are printed simultaneously.

The printer 270A comprises a paper transportation system 271, a first printer head 283, a second printer head 284, an upper paper feed system, and a lower paper feed system. The paper transportation system 271 includes a transportation belt 274 that transports paper. The first printer head 283 comprises head blocks 275, 276, 277, and 278. The second printer head 284 comprises head blocks 279, 280, 281, and 282. The structures of the first and second printer heads, and the components other than these components are identical to those of the printer 10 in accordance with the first embodiment.

The paper transportation system 271 includes the transportation belt 274, a driving roller 274, a driven roller 272, and a speed/position detection sensor (not shown). The transportation belt 274 for transporting paper is an endless belt. The driving roller 273 drives the transportation belt. A paper sucking means of a pneumatic type or an electrostatic type (not shown) is placed inside the transportation belt 274.

The upper paper feed system is a paper feed system located above the upper route of the transportation belt 274 along which the transportation belt 274 travels in the direction D1 (leftwards). The upper paper feed system comprises an upper paper feed tray 285, an upper paper feed roller 289 that is a paper positioning means, and an upper paper discharge tray 286.

The lower paper feed system is a paper feed system located below the lower route of the transportation belt 274 along which the transportation belt 274 travels in a direction D2 (rightwards). The lower paper feed system comprises a lower paper feed tray 287, a lower paper feed roller 290 that is a paper positioning means, and a lower paper discharge tray 288.

In the printer 270A of the present embodiment having the foregoing components, the upper paper feed system and the lower paper feed system feed paper simultaneously. Consequently, two sheets of paper are printed simultaneously.

Specifically, when a sheet of paper 28 is fed to the transportation belt 274, which has been driven, by the paper feed roller 289 and then transported in the direction D1, the paper 28 is printed sequentially in different colors by the first printer head 283. The paper 28 is then stowed in the paper discharge tray 286. At the same time, another sheet of paper 28 is fed to the transportation belt 274 by the paper feed roller 290, and then transported in the direction D2. The paper 28 is then printed sequentially in different colors by the second printer head 284. The printed paper 28 is stowed in the paper discharge tray 288. The contents of print to be produced by the first printer head 283 may be identical to or different from the contents of print to be produced by the second printer head 284. These paper feeding and transporting actions are performed under the control of the CPU 1.

According to the printer 270A in accordance with a thirteenth embodiment, printing is achieved along the upper and lower routes (advance and return routes) along which the transportation belt 274 travels in the directions D1 and D2 respectively. Compared with the printer 10 in accordance with the first embodiment, the printer 270A can print twice as much paper.

Next, a printer in accordance with a fourteenth embodiment of the present invention will be described below.

Figure 47:
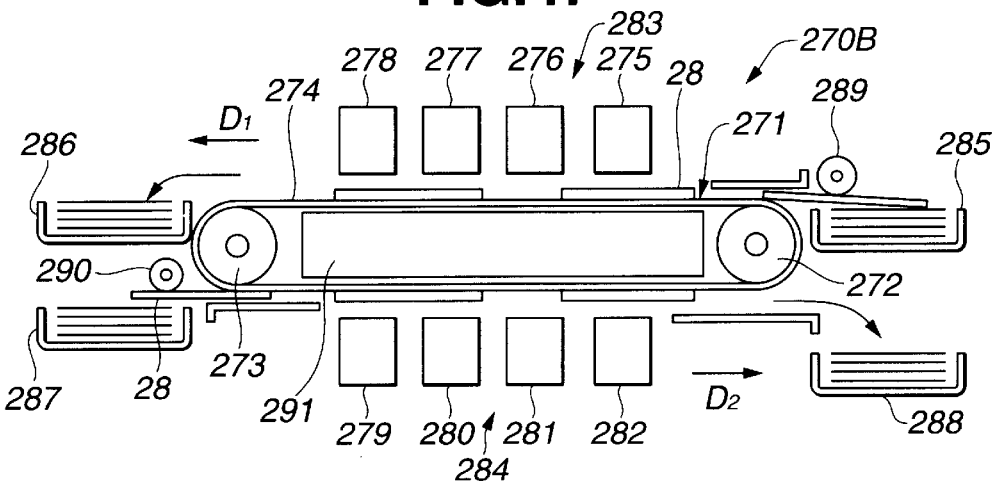
FIG. 47 is a side view showing the structure of a major portion of a printer in accordance with a fourteenth embodiment of the present invention.

FIG. 47 is a side view showing a major portion of a printer 270B in accordance with the present embodiment.

The printer 270B in accordance with the present embodiment is an inkjet printer for jetting out droplets of ink from a plurality of nozzles that covers the entire width of paper for the purpose of printing. Sheets of paper being transported in opposite directions along the advance and return routes of a transportation belt are printed simultaneously.

The printer 270B is different from the printer 270A in accordance with the thirteenth embodiment in a point that a pneumatic sucker 291 is incorporated as a paper sucking means. The other components are identical to those of the printer 270A. The different point alone will be described below.

In the printer 270B of the present embodiment, the pneumatic sucker 291 is placed inside the transportation belt 274. The sucker 291 has suction surfaces as upper and lower surfaces thereof. The sheets of paper 28 being transported along the upper and lower routes of the transportation belt are adsorbed to the transportation belt 274 through intake holes that are not shown and that are formed in the transportation belt 274. These paper transporting actions are performed under the control of the CPU 1.

The printer 270B in accordance with the present embodiment having the foregoing components provides the same advantage as the printer 270A in accordance with the thirteenth embodiment. In particular, the paper 28 is held reliably.

Next, a printer in accordance with a fifteenth embodiment of the present invention will be described below.

Figure 48:
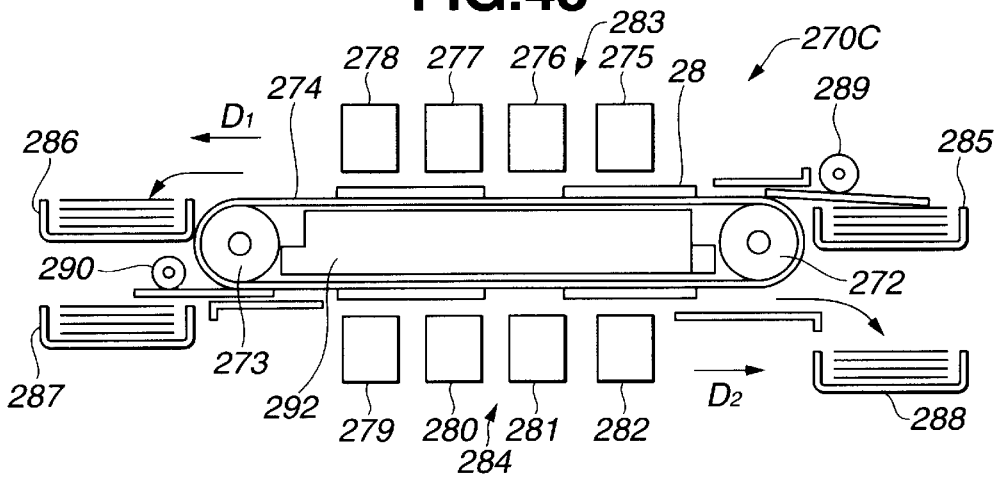
FIG. 48 is a side view showing the structure of a major portion of a printer in accordance with a fifteenth embodiment of the present invention.

FIG. 48 is a side view showing a major portion of a printer 270C in accordance with the present embodiment.

The printer 270C in accordance with the present embodiment is an inkjet printer for jetting out droplets of ink from a plurality of nozzles that covers the entire width of paper for the purpose of printing. Sheets of paper being transported in opposite directions along the advance and return routes of a transportation belt are printed simultaneously.

The printer 270C is different from the printer 270A in accordance with the thirteenth embodiment in a point that a pneumatic sucker 292 is incorporated as a paper sucking means. The other components are identical to those of the printer 270A. The different point alone will be described below.

In the printer 270C of the present embodiment, the pneumatic sucker 292 is placed inside the transportation belt 274. The sucker 292 has suction surfaces as upper and lower surfaces thereof. Sheets of paper 28 being transported along the upper and lower routes of the transportation belt are adsorbed to the transportation belt 274 through intake holes (not shown) and that are formed in the transportation belt 274. The lower suction surface of the sucker 292 that extends along the lower route along which the transportation belt travels in the direction D2 is longer than the upper suction surface. In other words, the lower suction surface is extended to lie near the outer circumferences of the rollers 273 and 272 respectively. This structure has been devised in efforts to overcome the effect of gravity with which paper being transported along the lower route of the transportation belt tends to drop. These paper transporting actions are performed under the control of the CPU 1.

The printer 270C in accordance with the present embodiment having the foregoing components provides the same advantage as the printer 270A in accordance with the thirteenth embodiment. In particular, the lower suction surface of the sucker 292 is made longer. Thus, while paper is being transported along the lower route of the transportation belt 274, sucking force works on the paper throughout the transportation of the paper in the direction D2 during which the paper must be sucked against gravity. Consequently, the paper 28 being transported along the lower route of the transportation belt is reliably held and successfully printed.

Next, a printer in accordance with a sixteenth embodiment of the present invention will be described below.

Figure 49:
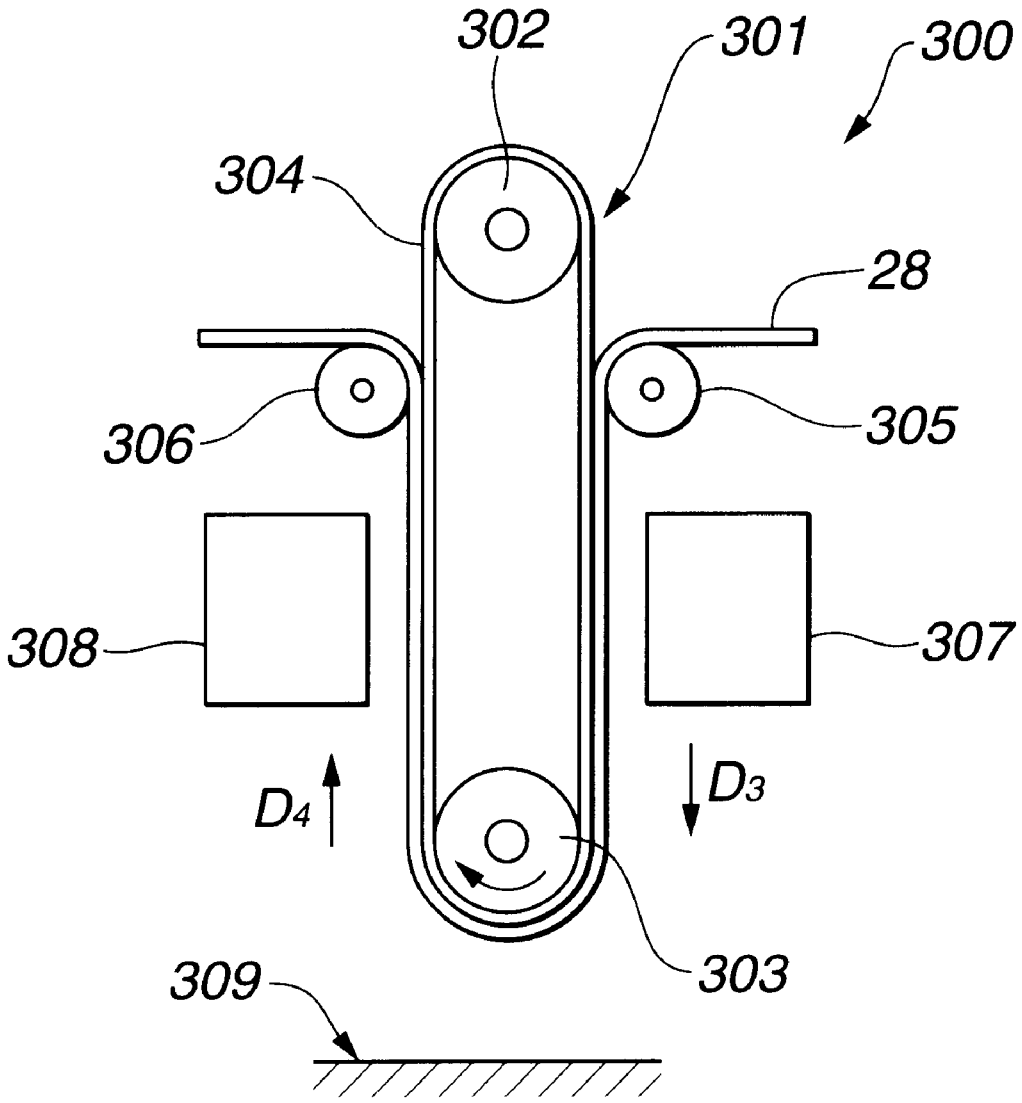
FIG. 49 is a side view showing the structure of a major portion of a printer in accordance with a sixteenth embodiment of the present invention.

FIG. 49 is a side view showing a major portion of a printer 300 in accordance with the present embodiment.

The printer 300 in accordance with the present embodiment is an inkjet printer for jetting out droplets of ink from a plurality of nozzles that covers the entire width of paper for the purpose of printing. One sheet of paper is printed while being transported in opposite directions D3 and D4 (along the advance and return routes of the transportation belt).

The printer 300 comprises a paper transportation system 301, a first printer head 307, a second printer head 308, a paper thrust roller 305 serving as a paper positioning means, and a paper discharge roller 306. The paper transportation system 301 includes a transportation belt 304 that moves vertically to transport paper. The other components are identical to those of the printer 10 in accordance with the first embodiment.

The paper transportation system 301 includes the transportation belt 304, a driving roller 303, a driven roller 302, and a speed/position detection sensor (not shown). The transportation belt 304 for transporting paper is an endless belt. The driving roller 303 that drives the transportation belt and the driven roller 302 lie at vertical positions with respect to a printer body installation surface 309. A paper sucking means of a pneumatic or electrostatic type (not shown) is placed inside the transportation belt 301.

The first printer head 307 and second printer head 308 have the same structures as members into which the printer head 3 employed in the first embodiment is bisected. For example, the first printer head 307 corresponds to the head blocks 31 and 32 shown in the perspective view of FIG. 4, and the second printer head 308 corresponds to the head blocks 33 and 34.

In the printer 300 of the present embodiment having the foregoing components, a sheet of paper 28 thrust into the transportation belt 304 by the paper thrust roller 305 is transported in a direction D3 along a downward route of the transportation belt 304, and then printed by the first printer head 307. Thereafter, the paper 28 is transported in an opposite direction D4 along an upward route of the transportation belt 304, and then printed by the second printer head 308. Thus, the paper is fully printed, and discharged by the paper discharge roller 306. These actions are performed under the control of the CPU 1.

According to the printer 300 in accordance with the sixteenth embodiment, the driving roller 303 and driven roller 302 are arranged lengthwise. The sideways dimension of the printer is therefore limited. Moreover, paper is printed while being transported in the directions D3 and D4 along the downward and upward routes of the transportation belt 304. The distance between the driving roller 303 and driven roller 302 is therefore short. This results in the compact printer. Moreover, the printer heads 307 and 308 are located by the right and left sides of the transportation belt 304. Equal gravity acts on ink drops jetted out from the right and left printer heads. Printing is achieved under the uniform conditions between the downward and upward routes.

Next, a printer in accordance with a seventeenth embodiment of the present invention will be described below.

Figure 50:
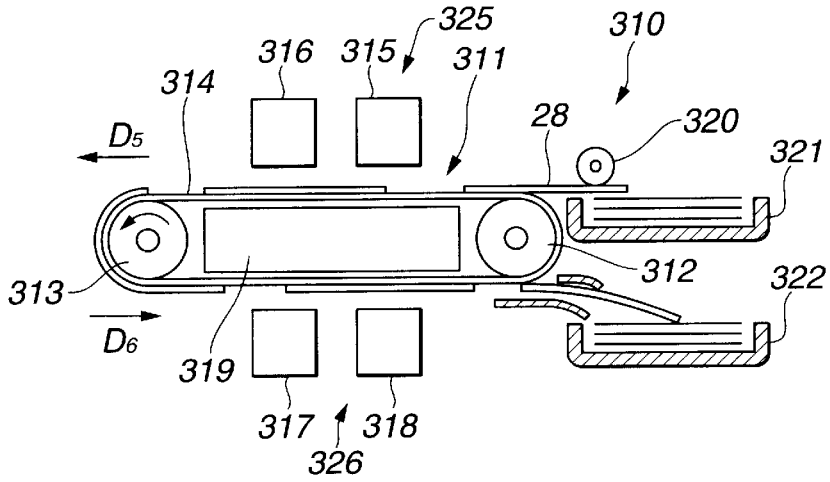
FIG. 50 is a side view showing the structure of a major portion of a printer in accordance with a seventeenth embodiment of the present invention.

FIG. 50 is a side view showing a major portion of a printer 310 in accordance with the present embodiment.

The printer 310 in accordance with the present embodiment is an inkjet printer for jetting out droplets of ink from a plurality of nozzles that covers the entire width of paper. One sheet of paper is printed in four colors while being transported in opposite directions along the advance and return routes of a transportation belt.

The printer 310 comprises a paper transportation system 311, a first printer head 325, a second printer head 326, a sucker 319, a paper thrust roller 320, a paper feed tray 321, and a paper discharge tray 322. The paper transportation system 311 includes a transportation belt 314 that transports paper. The sucker 319 is a pneumatic paper sucking means. The paper thrust roller 320 serves as a paper positioning means. The other components are identical to those of the printer 10 in accordance with the first embodiment.

The paper transportation system 311 includes the transportation belt 314, a driving roller 313, a driven roller 312, and a speed/position detection sensor (not shown). The transportation belt 314 for transporting paper is an endless belt. The driving roller 313 drives the transportation belt. The sucker 319 is placed inside the transportation belt 314.

The first printer head 325 comprises a black head block 315 and a yellow head block 316 that have the same structure as the single-color head block of a variant shown in FIG. 8. The second printer head 326 has a magenta head block 317 and a cyan head block 318 that have the same structure as the single-color head block of the variant shown in FIG. 8.

In the printer 310 of the present embodiment having the foregoing components, one sheet of paper 28 thrust into the transportation belt 314 by the paper thrust roller 320 is transported in a direction D5, that is, leftwards by the transportation belt 314, and printed in black and/or yellow by the first printer head 325. Thereafter, the paper 28 is transported in an opposite direction D6, that is, rightwards, and then printed in magenta and/or cyan by the second printer head 326. Thus, the paper is fully printed, and discharged into the paper discharge tray 322. These actions are performed under the control of the CPU 1.

According to the printer 310 of the seventeenth embodiment, two head blocks are arranged above and below the transportation belt 314. Consequently, the inter-shaft distance between the driving roller 313 and driven roller 312 can be shortened. The sideways dimension of the printer is limited. This results in the compact printer.

Next, a printer in accordance with the eighteenth embodiment of the present invention will be described below.

Figure 51:
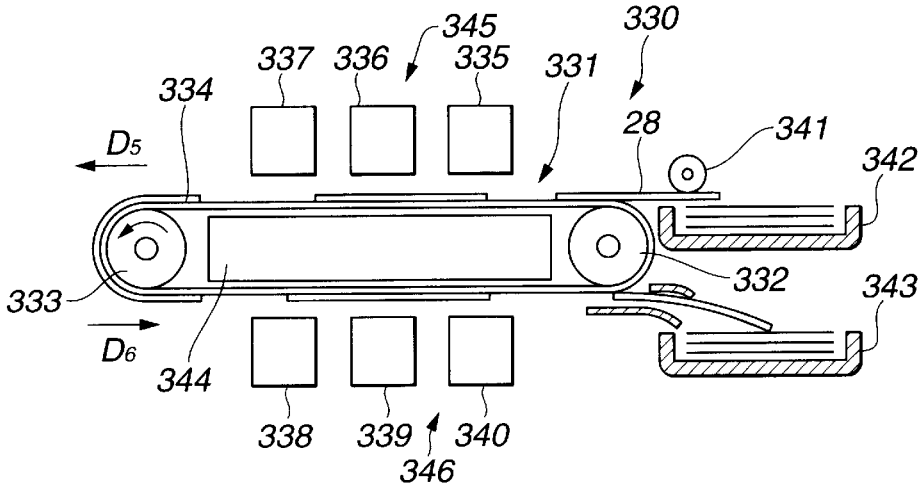
FIG. 51 is a side view showing the structure of a major portion of a printer in accordance with an eighteenth embodiment of the present invention.

FIG. 51 is a side view showing a major portion of the printer 330 in accordance with the present embodiment.

The printer 330 in accordance with the present embodiment is an inkjet printer for jetting out droplets of ink from a plurality of nozzles that covers the entire width of paper for the purpose of printing. One sheet of paper is printed in six colors while being transported in opposite directions along the advance and return routes of a transportation belt.

The printer 330 comprises a paper transportation system 331, a first printer head 345, a second printer head 346, a sucker 344, a paper thrust roller 341, a paper feed tray 342, and a paper discharge tray 343. The paper transportation system 331 includes a transportation belt 334 that transports paper. The sucker 344 is a pneumatic paper sucking means. The paper thrust roller 341 serves as a paper positioning means. The other components are identical to those of the printer 10 in accordance with the first embodiment.

The paper transportation system 331 includes the transportation belt 334, a driving roller 333, a driven roller 332, and a speed/position detection sensor (not shown). The transportation belt 334 for transporting paper is an endless belt. The driving roller 333 drives the transportation belt. The sucker 344 is placed inside the transportation belt 334.

The first printer head 345 comprises a black head block 335, a light magenta head block 336, and a light cyan head block 337 that have the same structure as the single-color head block of a variant which is shown in FIG. 8. The second printer head 346 comprises a yellow head block 338, a magenta head block 339, and a cyan head block 340 that have the same structure as the single-color head block of the variant shown in FIG. 8.

In the printer 330 of the present embodiment having the foregoing components, one sheet of paper 28 thrust into the transportation belt 334 by the paper thrust roller 341 is transported in a direction D5, that is, leftwards by the transportation belt 334, and then printed sequentially in black, light magenta, and light cyan by the first printer head 345. Thereafter, the paper 28 is transported in an opposite direction D6, that is, rightwards by the transportation belt 334 that is turned about the driving roller 333. The paper 28 is then printed sequentially in yellow, magenta, and cyan by the second printer head 346. After the paper 28 is thus fully printed, the paper is discharged into the paper discharge tray 343. These actions are performed under the control of the CPU 1.

According to the printer 330 of the eighteenth embodiment, three head blocks are arranged above and below the transportation belt 334 in order to print paper in multiple (six) colors. Moreover, the inter-shaft distance between the driving roller 333 and driven roller 332 is so short that the sideways dimension of the printer is limited. This results in the compact printer.

Next, a printer in accordance with a nineteenth embodiment of the present invention will be described below.

Figure 52:
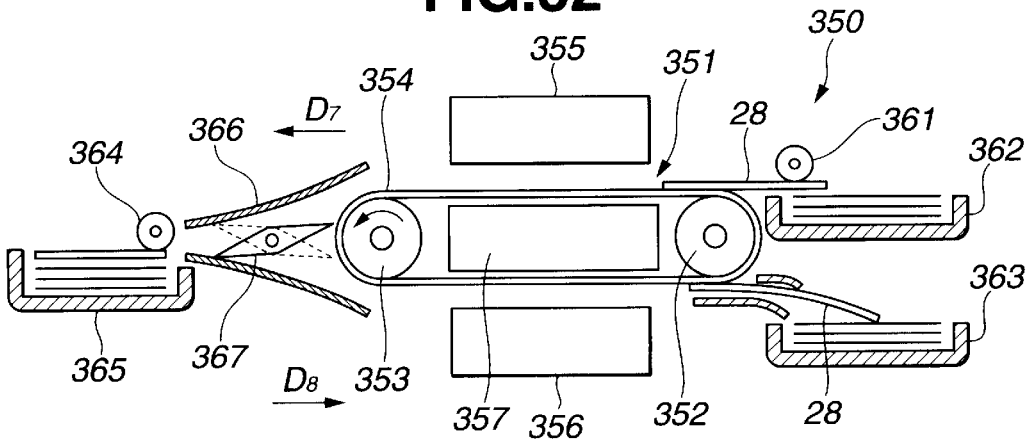
FIG. 52 is a side view showing the structure of a major portion of a printer in accordance with a nineteenth embodiment of the present invention.

FIG. 52 is a side view showing a major portion of a printer 350 in accordance with the present embodiment.

The printer 350 in accordance with the present embodiment is an inkjet printer for jetting out droplets of ink from a plurality of nozzles that covers the entire width of paper for the purpose of printing. A sheet of paper has both surfaces thereof printed while being transported in opposite directions D7 and D8 (along the advance and return routes of a transportation belt).

The printer 350 comprises a paper transportation system 351, a first printer head 355, a second printer head 356, a sucker 357, a paper thrust-in-forward direction roller 361, a paper feed tray 362, a paper discharge tray 363, a route changing mechanism 366, a paper feed/discharge tray 365, and a paper thrust-in-opposite direction roller 364. The paper transportation system 351 includes a transportation belt 354 that transports paper. The sucker 357 is a pneumatic paper sucking means. The paper thrust-in-forward direction roller 361 is placed above the driven roller 352. The paper discharge tray 363 is located below the driven roller 352. The route changing mechanism 366 is located by the side of the driving roller 353. The structures of the first printer head 355 and second printer head 356, and the components other than these components are identical to those of the printer 10 in accordance with the first embodiment.

The paper transportation system 351 includes the transportation belt 354, a driving roller 353, a driven roller 352, and a speed/position detection sensor (not shown). The transportation belt 354 for transporting paper is an endless belt. The driving roller 353 drives the transportation belt. A sucker 357 is placed inside the transportation belt 354.

The route changing mechanism 366 includes a changing plate 367 that can be turned and is placed along a paper discharge passage. The changing plate 367 can be driven alternately to a forward-direction guide position and an opposite-direction guide position. In other words, the position of the changing plate 367 can be changed to the forward-direction guide position or opposite-direction guide position.

When the changing plate 367 is located at the forward-direction guide position (position indicated with a solid line in FIG. 51), the paper 28 transported in a direction D7, that is, a forward direction by the transportation belt 354 is guided to the paper feed/discharge tray 365 as it is.

When the changing plate 367 is located at the opposite-direction guide position (position indicated with a dashed line in FIG. 51), if the paper thrust-in-opposite direction roller 364 is driven, the paper 28 in the paper feed/discharge tray 365 is thrust in a direction D8. The paper 28 is fed to the transportation belt 354 while being routed below the changing plate 367, and transported in a direction D8.

In the printer 350 of the present embodiment having the foregoing components, when the changing plate 367 of the route changing mechanism 366 is set to the forward-direction guide position, if the paper thrust-in-forward direction roller 361 is driven, the paper 28 is thrust from the paper feed tray 362 into the transportation belt 354. The paper 28 is then transported in the direction D7, that is, the forward direction by the transportation belt 354. The paper 28 has the one surface thereof printed by the first printer head 355.

The paper 28 having the one surface thereof printed is stowed in the paper feed/discharge tray 365 by way of the route changing mechanism 366.

After a predetermined number of sheets of paper has the one surfaces thereof printed, the changing plate 37 of the route changing mechanism 366 is changed to the opposite-direction guide position. When the paper thrust-in-opposite direction roller 364 is driven, one of the sheets of paper 28 having the one surfaces thereof printed is discharged from the paper feed/discharge tray 365, routed below the changing plate 367, fed to the transportation belt 354, and transported in the opposite direction D8. The paper 28 then has the back thereof printed by the second printer head 356. The paper 28 having both the surfaces thereof printed is then stowed as printed paper in the paper discharge tray 363. These actions are performed under the control of the CPU 1.

The printer 350 in accordance with the nineteenth embodiment provides the same advantage as the printer 10 in accordance with the first embodiment. Furthermore, the sideways dimension of the printer capable of printing both surfaces of paper can be confined to a value nearly the same as the sideways dimension of the printer in accordance with the first embodiment.

As described so far, according to the embodiments of the present invention, there is provided a printer that jets out ink drops from a plurality of nozzles so as to print one full line on paper. For the printer, a higher printing speed can be attained, the costs of manufacturing can be reduced, and a compact design can be realized. Moreover, the components of the printer can be adjusted, maintained, and managed easily.

What is claimed is:

1. A printer comprising:

a printer head capable of printing one full line on print paper without having to be shifted in a width direction of the print paper;

a transportation belt comprising an endless belt member which holds the print paper and transports the print paper in a direction orthogonal to the width direction of the print paper;

a printing control means for controlling jetting of ink drops from said printer head synchronously with transportation of the print paper by said transportation belt so as to achieve printing;

a print paper positioning means for positioning the print paper at a predetermined place on said transportation belt;

wherein said print paper positioning means comprises marks inscribed on said transportation belt in order to detect a position of the print paper held on said transportation belt, a mark detecting means for detecting the marks, and a print paper supplying means for supplying the print paper according to an output of said mark detecting means; and wherein said print paper supplying means supplies the print paper at a timing of the output of said mark detecting means, and the print paper is held in the predetermined place defined by the position of the paper held on said transportation belt which is detected using said marks.

2. A printer comprising:

a printer head capable of printing one full line on print paper without having to be shifted in a width direction of the print paper;

a transportation belt comprising an endless belt member which holds the print paper and transports the print paper in a direction orthogonal to the width direction of the print paper;

a printing control means for controlling jetting of ink drops from said printer head synchronously with transportation of the print paper by said transportation belt so as to achieve printing;

wherein said printer head is adapted to print in multiple colors, and comprises a plurality of single-color head blocks each having a plurality of head units arranged along a single oblique line.

3. A printer comprising:

a printer head capable of printing one full line on print paper without having to be shifted in a width direction of the print paper, said printer head comprising a plurality of nozzles;

a transportation belt comprising an endless belt member which holds the print paper and transports the print paper in a direction substantially orthogonal to the width direction of the print paper; and a printing control means for controlling a timing of jetting out ink from said nozzles according to a variation of an ink-jet distance between the print paper held on said transportation belt and an ink-jet surface included in said printer head so that ink drops are shot at correct points on the print paper.

4. The printer according to claim 3, wherein said printing control means infers a difference in thickness of said transportation belt from the variation of the ink-jet distance.

5. The printer according to claim 4, wherein said printing control means stores values of differences in the thickness of said transportation belt measured at points all over said transportation belt as the difference in the thickness of said transportation belt, and controls the timing of jetting out ink according to the measured values.

6. The printer according to claim 3, further comprising an ink-jet distance detecting means for measuring a distance to a surface of the print paper or of said transportation belt near the ink-jet surface included in said printer head, wherein said printing control means controls the timing of jetting out ink according to a point at which the distance to the surface of the print paper is measured by said ink-jet distance detecting means.

7. A printer comprising:

a printer head capable of printing one full line on print paper without having to be shifted in a width direction of the print paper, said printer head comprising a plurality of nozzles;

a transportation belt comprising an endless belt member which holds the print paper and transports the print paper in a direction orthogonal to the width direction of the print paper; and a control unit which controls jetting of ink drops from said printer head synchronously with transportation of the print paper by said transportation belt so as to achieve printing, wherein said transportation belt comprises a recovery area in which said printer head is enabled to recover an ability to jet out ink, said recovery area comprises at least one aperture which is smaller in size than said printer head so as not to disturb jetting of ink from said printer head, and said at least one aperture does not contact said printer head as said printer head recovers the ability to jet out ink.

8. The printer according to claim 7, wherein said transportation belt is adapted not to hold the print paper in said recovery area.

9. The printer according to claim 7, wherein said recovery area is an ink-jet area which is defined on said transportation belt and through which ink drops are jetted out from said nozzles in order to enable said nozzles to recover the ability to jet out ink.

10. The printer according to claim 9, further comprising a recovering device placed inside said transportation belt opposed to said printer head, and wherein:

said ink-jet area is an opening area having an opening smaller than said recovering device;

said transportation belt is moved to cause said ink-jet area to be aligned with said recovering device so that said printer head and said recovering device are directly opposed to each other for effecting recovery; and said recovering device is controlled by said control unit to receive ink drops jetted out from said nozzles in a state distant from surfaces of said nozzles.

* * * * *